US011986924B2

(12) United States Patent
Miyazawa et al.

(10) Patent No.: US 11,986,924 B2
(45) Date of Patent: May 21, 2024

(54) ELECTRICALLY POWERED TOOL

(71) Applicant: Koki Holdings Co., Ltd., Tokyo (JP)

(72) Inventors: Ken Miyazawa, Ibaraki (JP); Hironori Sakai, Ibaraki (JP)

(73) Assignee: Koki Holdings Co., Ltd., Tokyo (JP)

( * ) Notice: Subject to any disclaimer, the term of this patent is extended or adjusted under 35 U.S.C. 154(b) by 652 days.

(21) Appl. No.: 16/313,468

(22) PCT Filed: May 26, 2017

(86) PCT No.: PCT/JP2017/019711
§ 371 (c)(1),
(2) Date: Dec. 27, 2018

(87) PCT Pub. No.: WO2018/003369
PCT Pub. Date: Jan. 4, 2018

(65) Prior Publication Data

US 2019/0358769 A1 Nov. 28, 2019

(30) Foreign Application Priority Data

Jun. 30, 2016 (JP) ..... 2016-130338
Jan. 27, 2017 (JP) ..... 2017-013050

(51) Int. Cl.
*B24B 47/12* (2006.01)
*B24B 23/02* (2006.01)

(52) U.S. Cl.
CPC ..... *B24B 47/12* (2013.01); *B24B 23/02* (2013.01)

(58) Field of Classification Search
CPC ..... B24B 47/10; B24B 47/12; B24B 7/18; B24B 7/186; B24B 7/02; B24B 7/04;
(Continued)

(56) References Cited

U.S. PATENT DOCUMENTS 5,052,500 A * 10/1991 Ohtsu ..... B25F 5/006 173/162.2
6,293,859 B1 * 9/2001 Fink ..... B23D 45/16 451/344

(Continued)

FOREIGN PATENT DOCUMENTS

CN 1494994 5/2004
CN 1636680 7/2005

(Continued)

OTHER PUBLICATIONS

"Search Report of Europe Counterpart Application", datedJ un. 26, 2020, p. 1-p. 8.

(Continued)

*Primary Examiner* — Brian D Keller
*Assistant Examiner* — Marcel T Dion
(74) *Attorney, Agent, or Firm* — JCIPRNET

(57) ABSTRACT

Provided is an electrically powered tool configured so that a handle section is rotatable relative to a body section, wherein a motor housing is formed in a cylindrical integral structure, and a first drive circuit on which a switching element is mounted is received from a rear opening. The first drive circuit is disposed within a circular cylindrical case open to the rear side. A handle housing is provided with an air flow window, and a gear case is provided with a discharge opening. When a cooling fan rotates, air is sucked into the handle housing from the air flow window. Then, as indicated by the arrow, the air cools, within the motor housing, the switching element mounted on the first derive circuit, then cools the motor, and is discharged to the outside from the discharge opening.

15 Claims, 15 Drawing Sheets

(58) Field of Classification Search
CPC ..... B24B 7/045; B24B 7/05; B24B 23/02; B24B 23/028; B24B 23/03; B24B 23/04; B24B 41/007; B24B 55/02; B24B 55/04; B24B 55/045; B24B 55/05; B25F 5/02; B25F 5/008
USPC ..... 451/344, 357–359, 449, 448
See application file for complete search history.

(56) References Cited

U.S. PATENT DOCUMENTS

| | | | | |
|---|---|---|---|---|
| 6,540,545 | B1 * | 4/2003 | Itakura | B24B 23/005 310/50 |
| 2005/0058890 | A1 * | 3/2005 | Brazell | H01M 50/209 429/97 |
| 2005/0153636 | A1 * | 7/2005 | Numata | B25F 5/008 451/358 |
| 2006/0258274 | A1 * | 11/2006 | Oki | B25F 5/006 451/358 |
| 2008/0090504 | A1 * | 4/2008 | Trautner | B24B 23/00 451/359 |
| 2009/0179510 | A1 * | 7/2009 | Yoshida | H02K 11/048 310/62 |
| 2009/0207035 | A1 * | 8/2009 | Watanabe | B24B 49/12 340/657 |
| 2011/0171887 | A1 * | 7/2011 | Tanimoto | B24B 47/12 451/359 |
| 2015/0111480 | A1 * | 4/2015 | Vanko | B24B 23/028 451/359 |
| 2015/0263592 | A1 * | 9/2015 | Kawakami | H02K 3/522 310/50 |
| 2016/0020676 | A1 * | 1/2016 | Omura | B24B 23/028 310/50 |
| 2017/0106521 | A1 * | 4/2017 | Kelleher | B25F 5/008 |
| 2017/0136614 | A1 * | 5/2017 | Takeda | B24B 23/02 |
| 2019/0015946 | A1 * | 1/2019 | Karlsson | B24B 23/005 |
| 2019/0262971 | A1 * | 8/2019 | Kondo | H02K 7/145 |

FOREIGN PATENT DOCUMENTS

| | | |
|---|---|---|
| CN | 1658408 | 8/2005 |
| CN | 101224571 | 7/2008 |
| CN | 102149515 | 8/2011 |
| CN | 103862443 | 6/2014 |
| CN | 104428106 | 3/2015 |
| CN | 104742096 | 7/2015 |
| CN | 104755231 | 7/2015 |
| CN | 104924279 | 9/2015 |
| DE | 19900404 | 7/2000 |
| EP | 2189246 | 5/2010 |
| EP | 2762277 | 8/2014 |
| JP | H01281881 | 11/1989 |
| JP | H0544477 | 6/1993 |
| JP | 2534318 | 9/1996 |
| JP | 2007237357 | 9/2007 |
| JP | 2009142084 | 6/2009 |
| JP | 2010137308 | 6/2010 |
| JP | 2010173042 | 8/2010 |
| JP | 2010269409 | 12/2010 |
| JP | 2011104671 | 6/2011 |
| JP | 2012061552 | 3/2012 |
| JP | 4962896 | 6/2012 |
| JP | 2014133302 | 7/2014 |
| WO | 2014069369 | 5/2014 |

OTHER PUBLICATIONS

Office Action of China Counterpart Application, with English translation thereof, dated May 14, 2021, pp. 1-19.
"International Search Report (Form PCT/ISA/210) of PCT/JP2017/019711", dated Aug. 8, 2017, with English translation thereof, pp. 1-7.
"Office Action of China Counterpart Application" with English translation thereof, dated Oct. 22, 2021, p. 1-p. 12.
"Search Report of Europe Counterpart Application", dated May 11, 2022, p. 1-p. 9.
"Office Action of China Counterpart Application", dated Jan. 30, 2024, with English translation thereof, pp. 1-10.

* cited by examiner

ELECTRICALLY POWERED TOOL

CROSS-REFERENCE TO RELATED APPLICATION

This application is a 371 application of the international PCT application serial no. PCT/JP2017/019711, filed on May 26, 2017, which claims the priority benefit of Japan application no. 2016-130338, filed on Jun. 30, 2016 and Japan application no. 2017-013050, filed on Jan. 27, 2017. The entirety of each of the above-mentioned patent applications is hereby incorporated by references herein and made a part of this specification.

BACKGROUND

Technical Field

The present invention relates to an electrically powered tool such as a disk grinder.

Background Art

In portable electrically powered tools such as a disk grinder, a handle connected to protrude to the rear side from a motor housing in which a motor is held is provided. An operator grips the handle with one hand and performs an operation by pressing the motor housing itself or a side handle attached to the motor housing with the other hand. The housing of the disk grinder is a housing made of a metal or a synthetic resin. However, unlike a small size disk grinder, a medium or larger size disk grinder has a cylindrical motor housing because the size and output of the motor are larger and has, for example, a left and right division type handle housing that is divided in a cross section including a longitudinal axis on the rear side thereof. A configuration of the grinder in which a handle is provided behind such a motor housing is known in Patent Literature 1. In addition, in order to reduce vibration generated during working transmitted from a main body of an electrically powered tool to a handle (switch handle) connected to the main body of the tool, a vibration isolation mechanism is generally provided in a part connected to the handle. In an electrically powered tool including such a vibration isolation handle, an elastic body is inserted into a part connecting the main body of the electrically powered tool and the handle and the elastic body effectively absorbs vibration generated from the main body of the tool. For example, an electrically powered tool including a vibration isolation handle is disclosed in Patent Literature 2.

CITATION LIST

Patent Literature

[Patent Literature 1] Japanese Patent Publication No. 2012-61552

[Patent Literature 2] Japanese Patent No. 4962896

SUMMARY

Technical Problem

For tools having various working forms, it is important to have operability accordingly. For example, a disk grinder may have a working form such as polishing and cutting, and an operation is performed by changing a position of a tip tool. In order to perform polishing using the disk grinder, a grinding stone is attached and an annular surface of the disk-shaped grinding stone is pressed against a surface to be polished for a polishing operation. On the other hand, in order to perform cutting using the disk grinder, a rotary blade is attached and pressing is performed so that a surface of a disk-shaped rotary blade is orthogonal to a surface of a material to be polished for a cutting operation. In this manner, in the case of the disk grinder, an orientation of a body part during working is changed according to the tip tool attached. However, in this case, the position of the handle is also changed according to the change of the orientation of the body part.

In recent years, by adopting a brushless DC motor, electrically powered tools have become smaller and lighter. In addition, there is a trend for further increasing an output. A brushless DC motor is driven by using an inverter circuit using a semiconductor switching element. For the semiconductor switching element used in the inverter circuit, a field effect transistor (FET), an insulated gate bipolar transistor (IGBT), and the like are used. However, since such electronic elements generate a large amount of heat, it is necessary to cool them sufficiently. In addition, in electrically powered tools having an input of greater than 1,000 w, it is necessary to increase the capacity of IGBTs or electrolytic capacitors, a circuit board having these mounted thereon becomes larger, and thus it is necessary to devise a circuit board disposition method therefor.

The present invention has been made in view of the above background, and an objective of the present invention is to provide an electrically powered tool having improved workability by making a handle section rotatable with respect to a body part. Another objective of the present invention is to provide an electrically powered tool in which a vibration isolation elastic body is disposed between a body part and a handle section, excess deformation of the vibration isolation elastic body is prevented, and performance can be maintained over a long time of usage. Still another objective of the present invention is to provide an electrically powered tool using a cylindrical motor housing and in which switching elements and capacitors for driving a brushless motor are effectively disposed and a cooling effect thereof is improved. Yet another objective of the present invention is to provide an electrically powered tool in which a drive circuit for driving a motor is mounted on a body part on the side in front of a handle rotation mechanism section that rotates with respect to a main body of the electrically powered tool, cooling air is introduced into a motor housing through the rotation mechanism section from a handle side, and thus the cooling efficiency of the drive circuit is not reduced even in the handle rotation mechanism.

Solution to Problem

Representative aspects of the invention disclosed in this specification will be described as follows. According to one aspect of the present invention, there is provided an electrically powered tool including a cylindrical integral motor housing that accommodates and supports a brushless motor; a cooling fan that is rotated by the brushless motor; a spindle that is rotated by the brushless motor; a power transmission mechanism configured to transmit a rotational force of the brushless motor to the spindle; a gear case which is attached to an other side of the motor housing in an axial direction and in which the power transmission mechanism is accommodated; a handle housing which is connected to one side of the motor housing and in which a grip section is formed; and a drive circuit on which a switching element is mounted and which drives the brushless motor, wherein an air flow window is provided in the handle housing and a discharge opening is provided in the gear case. When the cooling fan rotates, air is sucked from the air flow window into the handle housing, the sucked air passes through an inside of the motor housing and cools the drive circuit, and then cools the brushless motor, and is discharged from the discharge opening to an outside. The handle housing has a diameter-increased section that has a larger diameter than the grip section and is connected to the motor housing, the diameter-increased section is positioned between the grip section and the motor housing, and the air flow window is provided in the diameter-increased section. In addition, the drive circuit is mounted on a first circuit board that extends in a direction substantially perpendicular to a rotation axis of the brushless motor. The first circuit board is accommodated in a case having an opening, and the opening of the case is disposed to face an air intake side.

According to another aspect of the present invention, an elastic body is provided between the motor housing and the handle housing, and the handle housing is supported by the motor housing via the elastic body. In addition, a rotation mechanism including a support member is provided between the motor housing and the handle housing, and the support member supports the handle housing to be rotatable about an axis of the brushless motor. In addition, the elastic body includes an inner elastic body provided on the side close to a central axis of the motor housing and an outer elastic body provided on the side far from the central axis of the motor housing, and the inner elastic body and the outer elastic body are provided superimposed on each other in the axial direction of the brushless motor. A metal annular member is provided between the outer elastic body and the handle housing.

According to still another aspect of the present invention, the rotation mechanism includes a swing supporting section that supports the handle housing in a swinging manner, and when the handle housing swings with respect to the motor housing, the elastic body provided in the swing supporting section is compressed. The rotation mechanism includes the support member that is fixed to the motor housing side and an intermediate member that is supported by the support member, the support member is formed of two or more separate pieces, and the intermediate member is clamped by the support member. The handle housing and the intermediate member are supported by the support member to be rotatable about an axis of the brushless motor. The intermediate member includes a rail part that rotatably supports the handle housing, the swing supporting section is formed on the side of the support member, a groove is formed on the side of the handle housing, the inner elastic body is provided in the swing supporting section. When the groove and the rail part are engaged, the handle housing is supported to be rotatable about an axis of the brushless motor.

According to still another aspect of the present invention, the drive circuit of the brushless motor is mounted on a first circuit board accommodated in the motor housing and further includes a second circuit board on which an operation unit configured to control the switching element is mounted, and the first circuit board is disposed between the second circuit board and the brushless motor. The handle housing has a diameter-increased section which has a larger diameter than the grip section and is connected to the motor housing, the diameter-increased section is positioned between the grip section and the motor housing, the air flow window is provided in the diameter-increased section, and the second circuit board is accommodated in the diameter-increased section. In addition, the handle housing is divisible and the second circuit board is held by being clamped by the handle housing. The first circuit board and the second circuit board are disposed to extend in a direction substantially perpendicular to a rotation axis of the brushless motor. The air flow window is disposed between the first circuit board and the second circuit board.

According to still another aspect of the present invention, the handle housing accommodates a third circuit board on which a noise filter circuit is mounted, and the second circuit board is disposed between the first circuit board and the third circuit board in a rotating shaft direction. The handle housing has a rim part having a larger diameter than the grip section on side of the grip section opposite to the diameter-increased section and the third circuit board is accommodated in the rim part. In addition, the diameter-increased section and the rim part are formed to gradually increase in diameter away from the grip section. The third circuit board includes a filter element that protrudes from a mounting surface, and the third circuit board is inclined with respect to a rotation axis and is accommodated so that a protrusion direction of the filter element and an extension direction of the grip section cross each other. A power cord for commercial AC power supply is provided in the rim part, a switch configured to turn the brushless motor on and off by an operation thereof is provided in the grip section, and inside the electrically powered tool, in the rotational axis direction, from the rear side, the power cord, the third circuit board, the switch, the first circuit board, and the brushless motor are accommodated in this order and electrically connected in this order. In addition, a rectifier circuit configured to rectify power supplied from the power cord is provided, and the rectifier circuit is mounted on the first circuit board is electrically connected between the switch and the switching element.

According to still another aspect of the present invention, there is provided an electrically powered tool including a motor; a cylindrical motor housing in which the motor is accommodated; and a handle that is connected to one side of the motor housing in an axial direction and is rotatable about the axial direction with respect to the motor housing, wherein an intermediate member which rotates integrally with the handle and in which a rotating shaft mechanism (either a rotating shaft part or a rotating groove) is formed, and a support member which is fixed to the side of the motor housing and in which a rotating shaft mechanism (a rotating groove or a rotating shaft part) corresponding to the rotating shaft mechanism (a rotating shaft part or a rotating groove) of the intermediate member is formed is provided. The support member and the intermediate member slide around an axis, and thus the motor housing and the handle are rotatably held. In addition, the power supplied to the motor is supplied from the side of the handle to the side of the motor housing via a wiring, and a through-hole through which the wiring passes is provided at the center of the rotating shaft of the intermediate member and the support member.

According to still another aspect of the present invention, a holding section that extends to a rear side from an outer edge of the through-hole while increasing in diameter is formed on a surface on a side opposite to the support member in the intermediate member. A handle housing that forms the handle is formed such that the handle housing is able to be divided into two parts on a surface including an axis of the rotating shaft part. The handle housing is attached to the intermediate member to clamp the holding section such that the handle housing is slidable along a curved outer circumferential surface of the holding section. In addition, an outer circumferential shape of the handle in the vicinity of a part connecting to the intermediate member is substantially circular, and a vibration isolation member formed of an elastic member is disposed at a position overlapping the rotating shaft part in the axial direction between a rear surface outer peripheral edge of the support member and a front outer peripheral edge of the handle. In addition, a second vibration isolation member for preventing sliding of the intermediate member and the handle is provided in the holding section of the intermediate member. The intermediate member is produced by integral molding of a synthetic resin and the support member is able to be divided on a surface including the axial direction so that the rotating shaft part of intermediate member is able to be clamped.

According to still another aspect of the present invention, there is provided an electrically powered tool including a cylindrical motor housing in which a motor is accommodated; and a handle that is connected to one side of the motor housing in an axial direction and has a left and right division type handle housing for the motor housing. The motor is disposed in the motor housing such that a rotating shaft is positioned in a longitudinal direction of the motor housing. An inverter circuit for driving the motor is mounted between a rear end of the rotating shaft of the motor and the rotation mechanism of the support member. A control circuit which controls the inverter circuit and includes a microcomputer is mounted at the same position as the inverter circuit or mounted separately on the handle housing side. The power supplied to the motor is supplied from the side of the handle to the side of the motor housing via a wiring, and a through-hole through which the wiring passes is provided at the axial center of the intermediate member and the support member. In addition, a plurality of air flow windows are provided on the outer circumferential side of the through-hole of the intermediate member and the support member and thus flowing of air from the side of the handle into the motor housing is allowed. The inverter circuit includes a plurality of switching elements mounted on a circuit board disposed orthogonal to a rotation axis of the motor. A cooling fan for generating cooling air is provided on the rotating shaft of the motor. Air sucked from the air flow window formed in the handle according to rotation of the cooling fan is introduced into the motor housing through the air flow window formed in the intermediate member and the support member, and cools the inverter circuit and the motor, and is then discharged in a direction of the other end of the motor housing (forward direction).

Advantageous Effects of Invention

According to the present invention, since a cylindrical integral motor housing is provided, it is possible to firmly fix the motor. In addition, since an air flow window (intake port) and a discharge opening (exhaust port) are provided in parts other than the motor housing, there is no need to provide a hole for sucking or exhausting air on the side surface of the motor housing, and it is possible to secure sufficient rigidity for the motor housing. In addition, since the drive circuit is cooled earlier than the motor, it is possible to effectively cool switching elements that generate heat. In addition, since the handle section rotates around the mother shaft with respect to the body part, the handle section can be appropriately rotated to a position according to the working orientation. In addition, since the vibration isolation members are provided at a plurality of positions in the vicinity of the outer circumferential part and the inner circumference, it is possible to greatly reduce vibration transmitted to the handle section from the side of the body part during working. The above and other objectives of the present invention and new aspects will be clearly understood from the following descriptions in this specification and drawings.

DESCRIPTION OF EMBODIMENTS

Example 1

Figure 1:
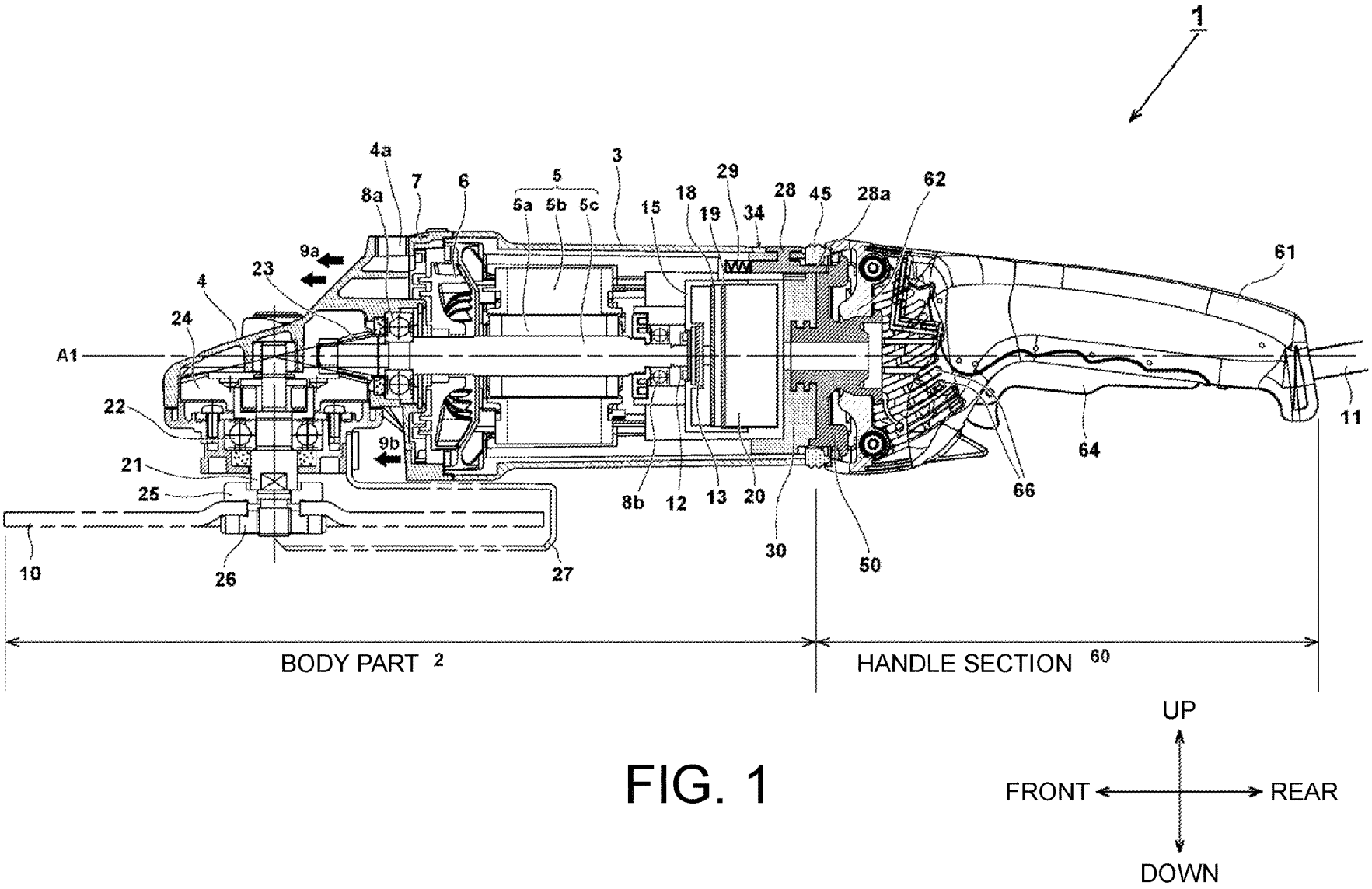
FIG. 1 is a longitudinal cross-sectional view (partial side view) showing an overall structure of a disk grinder 1 which is an electrically powered tool according to an example of the present invention.

Embodiments of the present invention will be described below in detail with reference to the drawings. Here, in all drawings for explaining embodiments, members having the same function are denoted with the same reference numerals and repeated descriptions thereof will be omitted. In addition, in this specification, front-rear, left-right, and up-down directions are assumed to be directions shown in the drawings.

FIG. 1 is a cross-sectional view (partial side view) showing an overall structure of an electrically powered tool in which a vibration isolation handle mechanism according to an example of the present invention is applied to a disk grinder 1. The disk grinder 1 includes a motor 5 serving as a driving source, a body part (a main body of the electrically powered tool) 2 including a work device (here, a grinder using a grinding stone 10 as a tip tool) that is driven by the motor 5, and a handle section 60 which is provided on a rear side of the body part 2 and is gripped by an operator. In the disk grinder 1, the body part (the main body of the electrically powered tool) 2 and the handle section 60 are rotatable (slidable) about a rotation axis A1 of the motor 5 by a predetermined angle. The handle section 60 can be rotated about the rotation axis A1 by 90 degrees to one side and 90 degrees to the other side from the state in FIG. 1 and the handle section 60 can be fixed to a motor housing 3 in a rotated state. In order to realize rotation about the rotation axis A1, the body part 2 and the handle section 60 are connected via a rotation mechanism. The rotation mechanism includes an intermediate member 50 which is held on the side of the handle section 60 and a support member 30 that pivotally supports the intermediate member 50 such that it can rotate about the rotation axis A1. Here, in order to realize a vibration control mechanism in addition to the rotation mechanism of the handle section 60, the intermediate member 50 rotates integrally with a handle housing 61, but the handle housing 61 is slightly swingable with respect to the intermediate member 50. That is, a hollow cone-shaped part is formed on a rear side of the intermediate member 50 and a mounting member 62 of the handle housing 61 is attached to a bell-shaped outer circumferential surface (curved surface part) thereof. The mounting member 62 of the handle section 60 has a substantially spherical inner circumferential sliding surface. When the inner circumferential sliding surface is fitted so that it can slide on the rear outer circumferential surface of the intermediate member 50, the handle section 60 is swingable with respect to the intermediate member 50.

The body part 2 includes the motor housing 3 made of, for example, a metal material, a gear case 4 made of, for example, a metal material, the disk-shaped grinding stone 10 attached to a spindle 21 that is pivotally supported on the gear case 4 by a bearing 22, and a wheel guard 27 that protects a part of the grinding stone 10. The motor housing 3 is formed in a substantially cylindrical shape, and has an integral structure which has an opening on the front side and the rear side and is made of a metal. The brushless DC type motor 5 that rotates according to a drive current controlled by an inverter circuit 20 is accommodated therein. The motor 5 is accommodated therein from the front side opening of the cylindrical motor housing 3. A rotating shaft 5*c* of the motor 5 is rotatably held by a bearing 8*b* that is provided in the vicinity of a center part of the motor housing 3 and a front side bearing 8*a* that is held by the gear case 4. A cooling fan 6 that rotates in synchronization with the motor 5 attached coaxially with the rotating shaft 5*c* is provided on the side in front of the motor 5 between it and the bearing 8*a*, and an inverter circuit board 19 for driving the motor 5 is disposed behind the motor 5. An air flow generated by the cooling fan 6 is taken from a slit-shaped air intake hole 66 formed on the side of the handle section 60, and then caused to pass through an air flow window (to be described below in FIG. 4 to FIG. 6; not shown in FIG. 1) of the rotation mechanism constituted by the intermediate member 50 and the support member 30, and flows from one side of the motor housing 3. The air flow flowing into the motor housing 3 passes mainly between a rotor 5*a* and a stator 5*b*, is sucked from the vicinity of the axial center of the cooling fan 6, flows to the outside of the cooling fan 6 in the radial direction, passes through an air hole of a bearing holder 7, and is discharged in the forward direction of the motor housing 3. Some of discharged cooling air is discharged to the outside through an exhaust port (not shown) formed in the gear case 4 as indicated by an arrow 9*a*. The remainder of air flown from the cooling fan 6 is discharged to the outside through an exhaust port (not shown) in the vicinity of the lower side of the bearing holder 7 as indicated by an arrow 9*b*.

The inverter circuit board 19 is a substantially circular double-sided board having substantially the same diameter as the external form of the motor 5 and is disposed orthogonal to the rotation axis A1. On the circuit board, six switching elements such as an insulated gate bipolar transistor (IGBT) (not shown) are mounted. A control circuit board 18 is disposed on the front side of the inverter circuit board 19 so that it is parallel to the inverter circuit board 19 and is a substantially circular both-sided board having substantially the same diameter as the motor 5, and on which a control circuit including a microcomputer (hereinafter referred to as a "microcom") is mounted. A disk-shaped sensor magnet 12 is provided in the vicinity of a rear end of the rotating shaft 5*c*, and a small sensor board 13 is disposed at a predetermined interval therefrom on the side behind the sensor magnet 12. Three position detecting elements such as a Hall IC (not shown) are mounted on the side of the sensor board 13 facing the sensor magnet 12 (motor side). The sensor board 13, the control circuit board 18, and the inverter circuit board 19 that are accommodated in a cup-shaped cylindrical case 15 are accommodated from the rear side opening of the motor housing 3 into a space behind a holding section of the bearing 8*b*. The cylindrical case 15 is fixed by the support member 30 installed on the rear side thereof.

The handle section 60 is a part that an operator grips during working and includes the handle housing 61 of a left and right two-division type formed by molding a plastic. A power cord 11 for supplying commercial power from the outside is connected to the rear end side of the handle section 60. A rectifier circuit (not shown), a trigger switch (not shown), a noise prevention electrical component (not shown) and the like connected to the power cord 11 are accommodated inside the handle housing 61. A trigger lever 64 for controlling turning the motor 5 on and off is provided below the handle housing 61. The trigger lever 64 is used to operate a trigger switch (not shown) and the trigger switch is connected to the control circuit board 18 through a plurality of (for example, two) signal lines. AC power (for example, commercial 100 V) supplied from the power cord 11 is converted into a high voltage DC (for example, direct current 141 V) by the rectifier circuit (not shown). The rectifier circuit can be realized as a known configuration including a diode bridge and a smoothing circuit, and the rectifier circuit is disposed inside the handle section 60 or mounted on the inverter circuit board 19. An output of the rectifier circuit is transmitted to the inverter circuit board 19 through a through-hole (to be described below) at the center part of the intermediate member 50 and the support member 30 via two power lines (not shown). In addition, a signal line (not shown) for connecting a switch operated by the trigger lever 64 and the control circuit board 18 passes through the through-hole (to be described below) at the center part of the intermediate member 50 and the support member 30.

In the gear case 4, a pair of bevel gears 23 and 24 that change a direction of a rotational force of the rotating shaft 5*c* of the motor 5 and transmit it to the spindle 21 are disposed. The grinding stone 10 is fixed to a lower end of the spindle 21 by a pressing fitting 26 via a bracket 25. A side handle mounting hole 4*a* is provided in an upper part of the gear case 4, and although not shown, the same side handle mounting hole is provided in a right side surface and a left side surface of the gear case 4, and a side handle (not shown) can be attached to respective parts. In this example, since the handle section 60 is rotatable with respect to the body part 2, a side handle can be attached at a position (any of upper, right, and left positions) at which it is easy to use when the handle section 60 is rotated 90 degrees. When an operator uses the disk grinder 1, if the handle section 60 is gripped by one hand and the side handle is gripped by the other hand, and the trigger lever 64 is pulled, the motor 5 is rotated, the grinding stone 10 is pressed against a workpiece (workpiece material), and an iron material is ground. At this time, since the grinding stone 10 rotates about the axis of the spindle 21, a reaction force in the rotation direction about the spindle 21 is transmitted to the motor housing 3.

A vibration isolation member 45 as a first elastic body is fitted into a peripheral part of the rear side opening of the motor housing 3. In a cross-sectional external form in a direction perpendicular to the central axis, shapes of an end of the motor housing 3 and a facing end of the handle housing 61 are not particularly limited, but they are circular. The vibration isolation member 45 is interposed between a rear end part (here, the support member 30) of the motor housing 3 and a peripheral part (front outer peripheral edge) of a front side opening edge of the handle housing 61, and when movement of the handle housing 61 in an axial vibration direction with respect to the motor housing 3 is restricted, vibration transmitted from the side of the body part 2 to the handle section 60 is reduced. On the rear end upper side of the motor housing 3, a stopper 28 for preventing rotation of the handle housing 61 about the rotation axis A1 is provided. The stopper 28 is movable in a direction (front-rear direction) parallel to the rotation axis A1, and a position on the handle section 60 in the rotation direction is fixed when a stopper piece 28*a* that extends rearward in the axial direction is engaged with a fixing hole (to be described below) of the intermediate member 50. Here, the handle section 60 may be rotated about the rotation axis A1 from the state in FIG. 1 to a position of +90 degrees (a position where the trigger lever 64 faces leftward) and a position of −90 degrees (a position where the trigger lever 64 faces rightward), and can be fixed at any of three positions. When the handle section 60 is rotated, the stopper 28 is moved to the front side, an engagement state between the stopper piece 28*a* and the intermediate member 50 is released, and the handle section 60 is then rotated.

Figure 2:
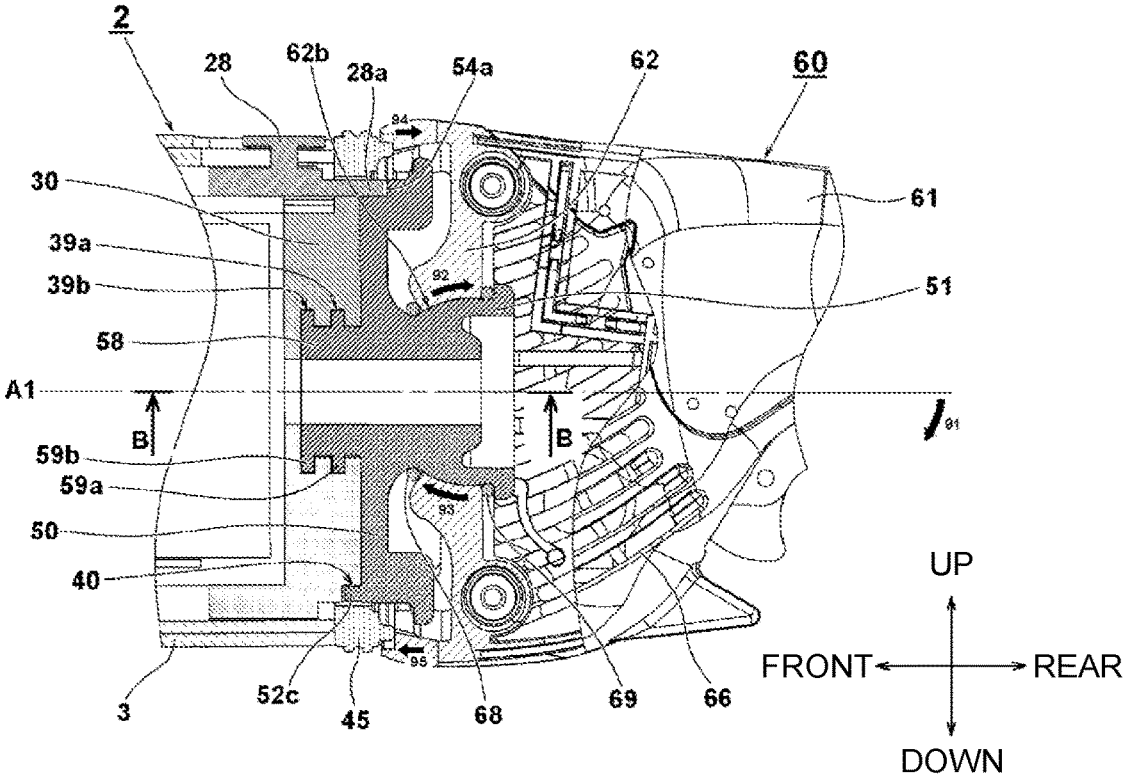
FIG. 2 is a partially enlarged cross-sectional view in the vicinity of a rotation mechanism in FIG. 1.

Next, a configuration in the vicinity of the rotation mechanism of the disk grinder 1 will be described with reference to FIG. 2. FIG. 2 is a partial enlarged view of the vicinity of the rotation mechanism in FIG. 1. The support member 30 is screwed to the motor housing 3 and does not rotate relative to the motor housing 3. The intermediate member 50 is pivotally supported by the support member 30 and is rotatable around a rotating shaft 58. The intermediate member 50 is held so that it can slide slightly with respect to the handle housing 61. On the rear side (the side opposite from the support member 30) in the vicinity of the central axis of the intermediate member 50, a holding section 51 whose diameter increases in a cone shape is formed. The outer circumferential surface of the holding section 51 is formed in a bell shape, and the outer circumferential surface is curved outward in the radiation direction behind the center of the intermediate member 50 and forms a part that supports swinging of the handle housing 61. The mounting member 62 is held to the holding section 51 so that a spherical inner wall surface 62*b* is in contact therewith. The mounting member 62 is produced by integrally molding with the handle housing 61. The handle housing 61 is formed to be divided into two parts in the left-right direction and screwed on a vertical surface including the rotation axis A1. Elastic members 68 and 69 such as an O-ring are provided on the side in front of a contact surface between the holding section 51 and the mounting member 62. These members function as a vibration isolation member for preventing sliding of the mounting member 62 on the holding section 51.

When a force is applied to the handle section 60 in a direction of an arrow 91 when a reaction of a force applied from a tip tool, the mounting member 62 swings in directions of arrows 92 and 93. Although this swinging is slight, a force acts in a direction in which the elastic member 69 is compressed in an upper side part, and a force acts in a direction in which the elastic member 68 is compressed in a lower part. That is, the elastic members 68 and 69 act as second vibration isolation members and swinging of the handle section 60 is prevented by the elastic members 68 and 69. In addition, a lower side of the front side cylindrical edge of the handle housing 61 comes in contact with the vibration isolation member 45 as indicated by an arrow 95. On the other hand, an upper side of the front side cylindrical edge of the handle housing 61 moves away from the vibration isolation member 45 as indicated by an arrow 94. Since the vibration isolation member 45 is disposed at a position overlapping a rotating shaft part (a connection part between the intermediate member 50 and the support member 30) in the axial direction, and a rotation support part of the handle section 60 and the vibration isolation member 45 can be disposed without being separated in a direction parallel to the rotation axis A1, it is possible to minimize an increase in the size of a main body, and swinging of the handle section 60 is effectively reduced by an action of the vibration isolation member 45. In this manner, the handle housing 61 is configured such that the intermediate member 50 is rotatably held by the rotating shaft 58 with respect to the support member 30, and vibration isolation is performed in two inside and outside places when viewed from the mounting member 62. As a result, as indicated by the arrows 94 and 95, slight vibration in the axial direction is allowed, and this vibration is damped by the vibration isolation member 45 and the elastic members 68 and 69. Therefore, as a result, it is possible to significantly damp the vibration generated from the side of the body part 2 and transmitted to the handle section 60.

Figure 3:
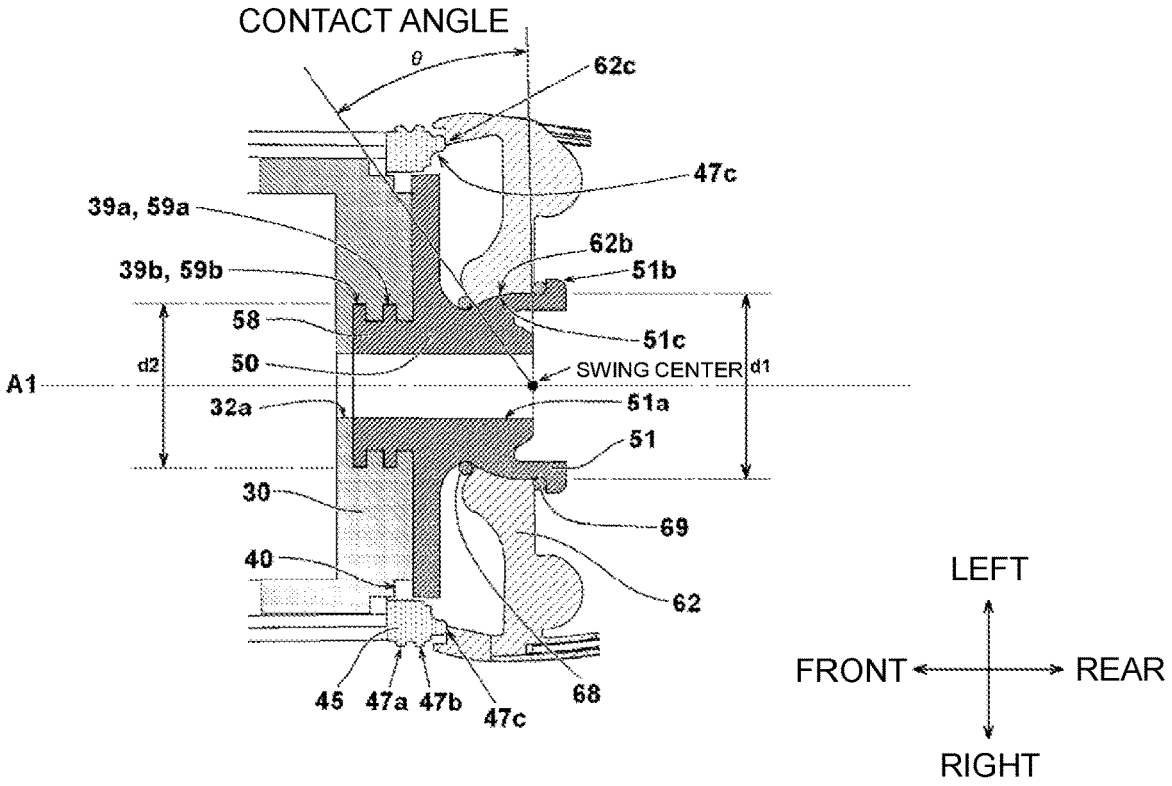
FIG. 3 is a cross-sectional view taken along the line B-B in FIG. 2.

FIG. 3 is a cross-sectional view taken along the line B-B in FIG. 2, and is a diagram for explaining a positional relationship between the support member 30, the vibration isolation member 45, the intermediate member 50, and the mounting member 62. In the intermediate member 50, the cylindrical rotating shaft 58 is formed to extend to the front side. The rotating shaft 58 is pivotally supported by the support member 30 having a 2-part structure. In the rotating shaft 58, flange parts 59*a* and 59*b* that extend outward in the radial direction from the outer circumferential surface are formed. These are held by being fitted to annular grooves 39*a* and 39*b* formed in the support member 30 and thus the intermediate member 50 is pivotally supported so that it does not fall off of the support member 30 in the axial direction. When a plurality of annular grooves 39*a* and 39*b* which are grooves for rotation are provided instead of one groove, it is possible to prevent the handle section 60 from being separated from the body part 2 (disengagement prevention). Here, an outer diameter d1 of a sliding part (outer surface) of the holding section 51 of the mounting member 62 may be set to be relatively large in order to secure the mechanical strength, and when an inner diameter d2 of the annular grooves 39*a* and 39*b* has a size similar thereto, this is advantageous in consideration of strength.

When the body part 2 vibrates due to a connection structure of the handle housing 61 and the mounting member 62 described above, the handle housing 61 vibrates around a spherical center point (swing center point) of a spherical outer circumferential surface of the intermediate member 50. However, in this case, the mounting member 62 slips or slides on a hemispherical outer circumferential surface of the intermediate member 50 and thus moves along a curved surface (the inner wall surface 62*b*), and the elastic members 68 and 69 having an O-ring shape disposed between the intermediate member 50 and the mounting member are compressed, and thus it is possible to damp vibration. The inner wall surface 62*b* is formed in the same manner as a part of a sphere centered on the swing center point. In addition, a cylindrical outer circumference front edge of the mounting member 62 comes in contact with the vibration isolation member 45. The vibration isolation member 45 has substantially the same cross-sectional shape in the circumferential direction except for protrusions 46*a* to 46*d* for preventing rotation to be described below with reference to FIG. 4. When the vibration isolation member 45 is viewed in the cross-sectional shape, two protrusions 47*a* and 47*b* that protrude outward in a flange shape from the outer circumferential surface are formed, and a vibration isolation effect is improved. In addition, on the rear side of the vibration isolation member 45, a protrusion 47*c* that extends in a flange shape in the axial direction is formed. When the protrusion 47*c* is brought very close to a front end surface of the outer edge of the mounting member 62, initial damping characteristics are improved. Here, the protrusions 47*a* to 47*c* are not necessarily limited to forming a required shape, and they may have other shapes as long as a damping effect which is an objective of the vibration isolation member 45 is obtained, and an elastic member having a simple cross-sectional shape may be used without the protrusions 47*a* to 47*c* being formed.

When the handle housing 61 swings around the swing center point, a movement distance of the handle housing 61 partially varies according to a distance from the swing center point. Specifically, a partial movement distance of the handle housing 61 is larger farther from the swing center point. The vibration isolation member 45 has a shorter distance from the swing center point than that of disposition positions of the elastic members 68 and 69, and a partial movement distance of the handle housing 61 in contact therewith is relatively large. Therefore, in this example, a spring constant of the inner elastic members 68 and 69 having an O-ring shape is larger than a spring constant of the outer vibration isolation member 45. That is, the elastic members 68 and 69 having an O-ring shape are elastic bodies that are harder than the vibration isolation member 45. Therefore, during swinging when a predetermined load is applied to the handle housing 61, the elastic members 68 and 69 can exhibit a sufficient vibration isolation effect with less compression even if they are disposed further inward than the vibration isolation member 45. In addition, in such a configuration, it is possible to effectively offset vibrations with different frequency components. That is, since high frequency vibration can be offset by the elastic members 68 and 69 with a large spring constant, and low frequency vibration can be offset by the vibration isolation member 45 with a small spring constant, it is possible to reduce vibration during working.

On the outer circumferential side of a through-hole 51*a* of the intermediate member 50, the cone-shaped holding section 51 is formed. A collar section 51*b* that extends outward in the radial direction is formed in the outer circumferential part of the rear side opening edge of the holding section 51, restricts a rotatable range of the mounting member 62, and performs pressing so that the mounting member 62 does not fall off of the intermediate member 50 to the rear side. When a contact angle θ between the holding section 51 and the mounting member 62 increases to a certain extent, it is possible to improve ease of swinging and a vibration control effect in the vibration isolation member 45 during swinging. In addition, when a swing angle θ is larger, a load in the thrust direction can be effectively received. The elastic member 69 is disposed between the collar section 51*b* and the mounting member 62. In addition, the elastic member 68 is disposed between a disk section 50*a* of the intermediate member 50 and the mounting member 62. The vibration isolation member 45 can limit a sliding distance of the handle housing 61 when a load is applied in cooperative action with the outer edge part of the mounting member 62, and thus the operability can be improved. The outer circumferential shape of the mounting member 62 of the handle housing 61 is formed in a cylindrical shape. In the cylindrical part, additionally, a step part 62*c* whose outside protrudes to the front side and whose inside retracts to the rear side is formed, and comes in contact with the vibration isolation member 45 in an inside retracted area. The vicinity of the outer edge part of the handle housing does not come in contact with the support member 30 and the intermediate member 50, and comes in contact with only the vibration isolation member 45. In addition, on the rear side of the vibration isolation member 45, the protrusion 47*c* that extends in a rib shape in the axial direction is formed. Therefore, it is possible to reduce resistance when the vibration isolation member 45 as a non-rotation member and the handle housing 61 as a rotation member rotate, and it is possible to effectively control vibration when vibration is initially input. In addition, when an amplitude of vibration increases, the protrusion 47*c* sufficiently crushed and then comes in contact with a body part of the vibration isolation member 45. Therefore, it is possible to realize a damping mechanism having high rigidity and a strong vibration control effect. Here, degrees of initial damping characteristics of the handle housing 61 and a shape of the outer circumferential surface may be optimally set according to required damping characteristics, a rigidity, and the like.

Figure 4:
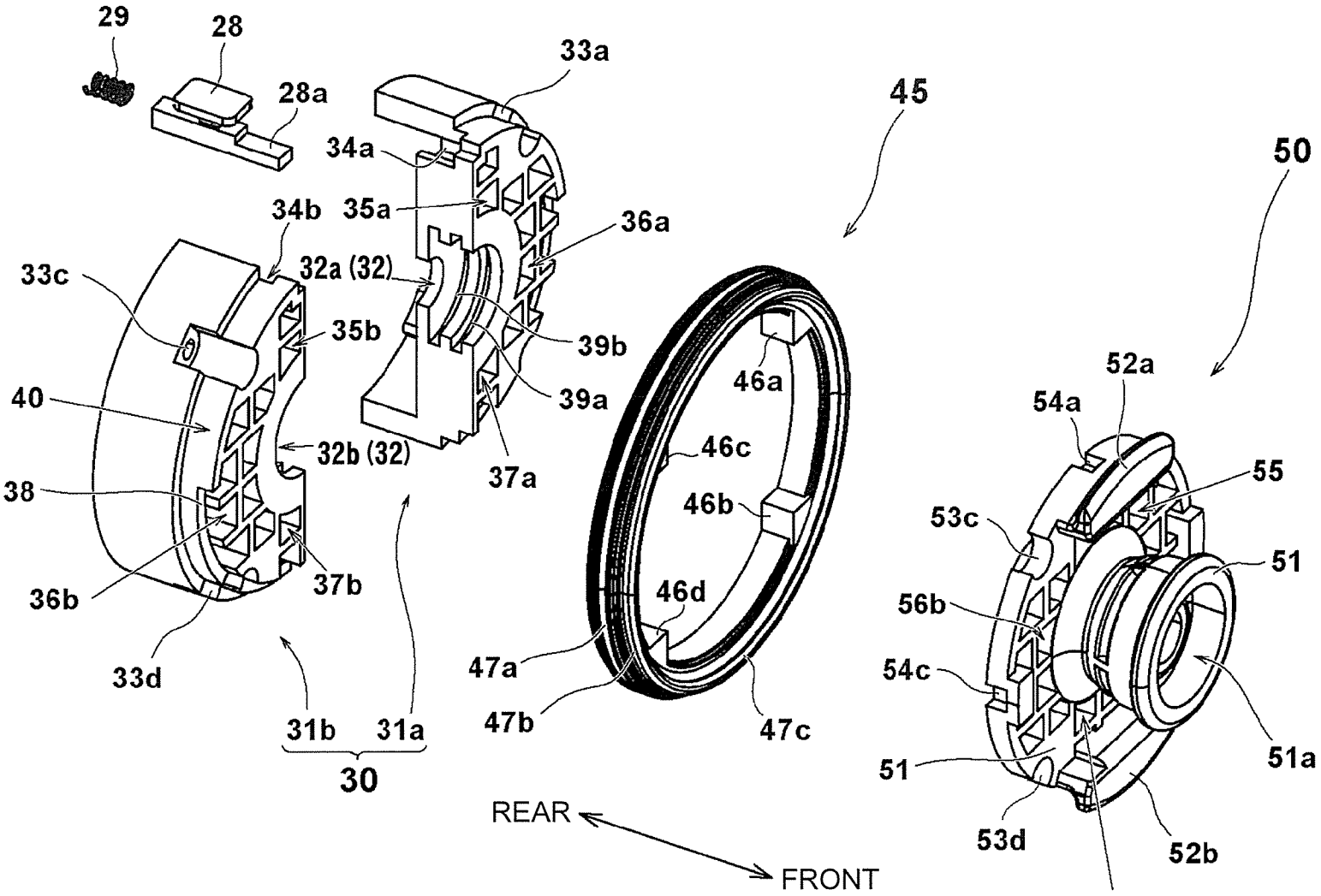
FIG. 4 is an exploded perspective view of the rotation mechanism in FIG. 2.

FIG. 4 is an exploded perspective view of the rotation mechanism in FIG. 2. The rotation mechanism is mainly constituted by the intermediate member 50 in which the rotating shaft 58 (refer to FIG. 3) is formed and the support member 30, and the vibration isolation member 45 and the stopper 28 are added thereto. The support member 30 and the intermediate member 50 are manufactured from molded synthetic resins such as polyamide-based synthetic fibers, the intermediate member 50 is integrally produced, and the support member 30 is formed into two left and right parts with respect to a vertical surface through a rotating shaft rotation axis A1. A right side 31*a* and a left side 31*b* of the support member 30 are formed in a plane-symmetrical shape with respect to a division surface. In the support member 30, a through-hole 32 (32*a* and 32*b*) is formed at the center. On the inner circumferential surfaces of the through-holes 32*a* and 32*b*, the annular grooves 39*a* and 39*b* which are continuous in the circumferential direction are formed. The support member 30 is screwed to the motor housing 3 by screws (not shown) using four screw holes 33*a* to 33*d* (in FIG. 4, the screw hole 33*b* is not shown) with the rotating shaft 58 (refer to FIG. 3) of the intermediate member 50 therebetween. Here, when the support member 30 is fixed to the motor housing 3, the support member 30 is fixed while it holds the intermediate member 50. A plurality of air flow windows 35*a*, 35*b*, 36*a*, 36*b*, 37*a*, and 37*b* through which air flows in the axial direction are formed further outward in the radial direction than the through-holes 32*a* and 32*b* of the support member 30. In addition, in the vicinity of the upper side of a junction part between the right side 31*a* and the left side 31*b*, a stopper holding groove 34 (34*a* and 34*b*) which is a space in which the stopper 28 is movably held in the axial direction is formed. The stopper 28 accommodated in the stopper holding grooves 34*a* and 34*b* extends to the rear side and is fitted to one of fixing holes 54*a* to 54*c* (here, 54*b* is not shown in FIG. 4) of the intermediate member 50. The stopper 28 is biased to the rear side in the axial direction by a spring 29 disposed between it and the motor housing 3. In addition, on the outer circumferential side of the air flow windows 37*a* and 37*b*, a notch 38 for restricting a rotation range of a stopper piece 52*c* (refer to FIG. 2) of the intermediate member 50 is formed.

The vibration isolation member 45 is formed in a ring shape, and the support member 30 is screwed to the motor housing 3, and is then fitted into a step part 40 formed in the vicinity of the rear surface outer peripheral edge of the support member 30. The vibration isolation member 45 is made of an elastic body having a strong vibration control effect, for example, a rubber body, and four parts on the inner circumferential side are partially engaged with the screw holes 33*a* to 33*d*, and thus the protrusions 46*a* to 46*d* that prevent rotation of the vibration isolation member 45 about the rotation axis A1 are provided. Since the protrusions 46*a* to 46*d* are fitted into dent parts (escape groove parts of the support member 30 provided behind the screw holes 33*a* to 33*d*) for applying a tool such as a driver to the screw holes 33*a* to 33*d*, the vibration isolation member 45 does not rotate relative to the support member 30. A cross-sectional shape of the surface including the rotation axis A1 of the vibration isolation member 45 is arbitrary. However, in order to effectively reduce vibration due to a compression load in the axial direction, the flange-like protrusions 47*a* and 47*b* which are continuous in the axial direction are formed on the outer circumferential surface.

In the intermediate member 50, a plurality of air flow windows 55, 56*a*, 56*b*, and 57 (here, 56*a* is not shown in FIG. 4) are formed in the disk section 50*a*, and on the outer peripheral edge, screw-passing grooves 53*c* and 53*d* through which screws (not shown) installed in fixing holes 54*a* and 54*c* and the screw holes 33*a* to 33*d* pass are formed. On the outer circumferential side of the through-hole 51*a* of the intermediate member 50, the cone-shaped holding section 51 is formed. The holding section 51 is formed in a hollow shape and the through-hole 51*a* is formed therein. On two upper side and lower side parts of the intermediate member 50, rotation preventing parts 52*a* and 52*b* that prevent rotation of the handle housing 61 so that it does not rotate relative to the intermediate member 50 are formed.

Figure 5:
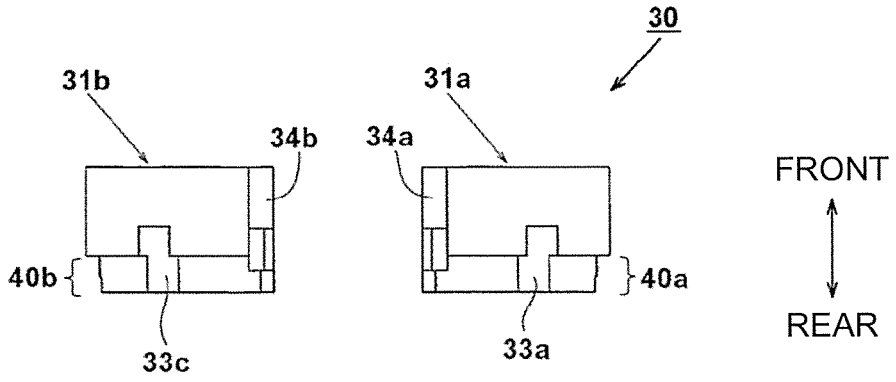
FIGS. 5(1) and 5(2) are diagrams showing the shape of a support member 30 in FIG. 4, FIG. 5(1) being a top view, and FIG. 5(2) a rear view.
Figure 5:
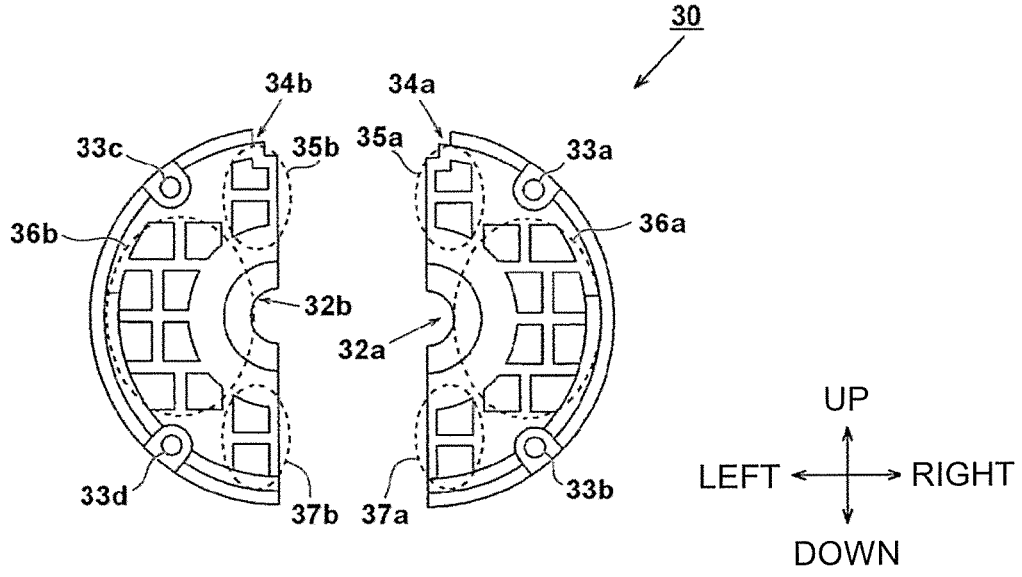

FIG. 5(1)~5(2) are diagrams showing the shape of the support member 30, FIG. 5(1) is a top view, and FIG. 5(2) is a rear view and is a diagram showing a state in which separation from a division surface is performed. In the rear side peripheral part of the support member 30, the step part 40 (40*a*, 40*b*) for installing the vibration isolation member 45 is formed. FIG. 5(2) shows positions of a plurality of air flow windows formed. As indicated by dotted lines, as the air flow windows, the air flow windows 35*a* and 35*b* above the through-hole 32 (32*a* and 32*b*), the air flow window 36*a* on the right side and the air flow window 36*b* on the left side, and the lower air flow windows 37*a* and 37*b* are formed. Respective air flow windows are formed by a plurality of cutout parts that penetrate in the axial direction. In this manner, when a plurality of cutouts are formed, cooling air generated by the cooling fan 6 (refer to FIG. 1) flows from the internal space side of the handle housing 61 into the motor housing 3 through the support member 30, and components (such as the inverter circuit board 19 and the control circuit board 18) housed in the motor housing 3 can be cooled. In particular, since the inverter circuit board 19 in which an IGBT as a switching element is mounted is positioned on the side furthest upstream in the cooling air inside the motor housing 3, the inverter circuit board 19 can be cooled efficiently.

Figure 6:
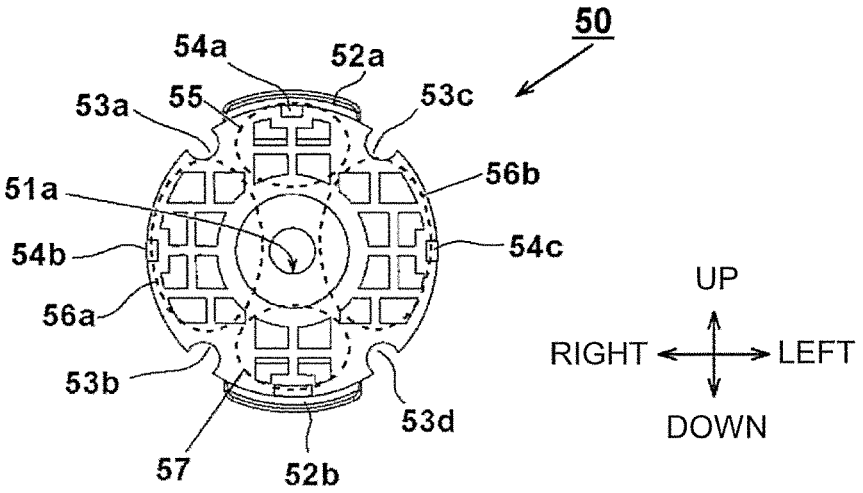
FIGS. 6(1)~6(3) are diagrams showing the shape of an intermediate member 50 in FIG. 4, FIG. 6(1) being a front view, FIG. 6(2) a side view, and FIG. 6(3) a rear view.
Figure 6:
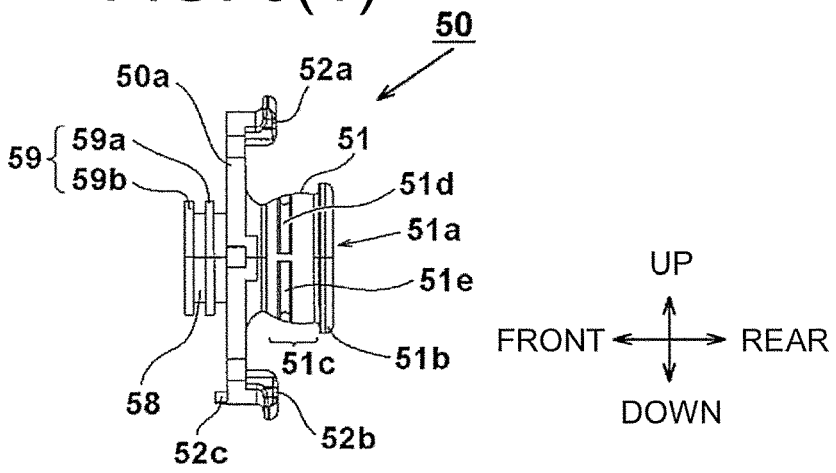
Figure 6:
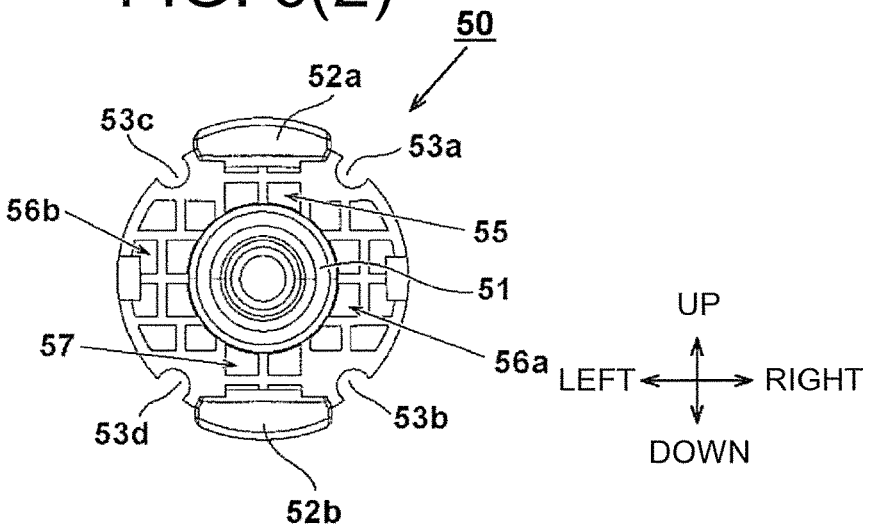

FIGS. 6(1)~6(3) are diagrams showing the shape of the intermediate member 50, FIG. 6(1) is a front view, FIG. 6(2) is a side view, and FIG. 6(3) is a rear view. Also in the intermediate member 50, the air flow window 55 above the through-hole 51*a*, the air flow window 56*a* on the right side, the air flow window 56*b* on the left side, and the lower air flow window 57 are formed. These air flow windows are formed at positions corresponding to the air flow windows 35*a*, 35*b*, 36*a*, 36*b*, 37*a*, and 37*b* formed in the support member 30. In addition, even if the intermediate member 50 is rotated 90 degrees clockwise or counterclockwise with respect to the support member 30 when viewed from the rear side, positions of facing air flow windows favorably coincide with each other, and thus cooling air can favorably pass from the rear side of the intermediate member 50 to the front side of the support member 30. Here, in a part of the through-hole 51*a*, two power lines (not shown) and several signal lines (output lines of the trigger switch) are disposed. However, since the inner diameter of the through-hole 51*a* is sufficiently larger than the total thickness of the power lines and signal lines and has a gap, this part of the through-hole 51*a* can be useful in order to allow cooling air to pass therethrough.

FIG. 6(2) is a side view. The intermediate member 50 forms the rotating shaft 58 and functions as a holding member for holding the handle section 60. The support member 30 is firmly fixed to the motor housing 3 by four screws that are disposed at equal intervals in the circumferential direction. However, in the intermediate member 50, the holding section 51 having a bell-shaped external shape is formed on the rear side of the disk section 50*a* and the handle housing 61 is held by the holding section 51. On the outer circumferential surface of the holding section 51, a sliding surface 51*c* formed in an arc shape when viewed in a cross section is formed, and on the rear end side of the sliding surface 51*c*, the collar section 51*b* that extends outward is formed. Since the sliding surface 51*c* has a shape that is continuous in the circumferential direction, if there is no rotation prevention member, the handle housing 61 is rotatable continuously with respect to the rotation axis A1. Thus, in the intermediate member 50 in this example, the two rotation preventing parts 52*a* and 52*b* are provided and these are engaged with dent parts formed on the inner wall side of the handle housing 61. Therefore, movement of the handle housing 61 in the rotation direction with respect to the intermediate member 50 is prevented, and the handle housing 61 and the intermediate member 50 rotate integrally about the rotation axis A1. In addition, when the stopper piece 52*c* is formed in the lower part on the side in front of the intermediate member 50 and is moved within the notch 38 of the support member 30, a rotation range of the intermediate member 50 with respect to the support member 30 is limited.

FIG. 6(3) is a rear view. The air flow windows 55, 56*a*, 56*b*, and 57 shown in FIG. 1) are formed to penetrate from the front side to the rear side of the disk section 50*a*. The rotation preventing parts 52*a* and 52*b* are provided at two parts, the upper part and the lower part, but the present invention is not limited to such disposition. Any shape which is not shown in the drawings may be used as long as it is possible to prevent rotation around the rotation axis A1 while slight swinging of the handle housing 61 and the intermediate member 50 in the axial vibration direction is allowed.

Figure 7:
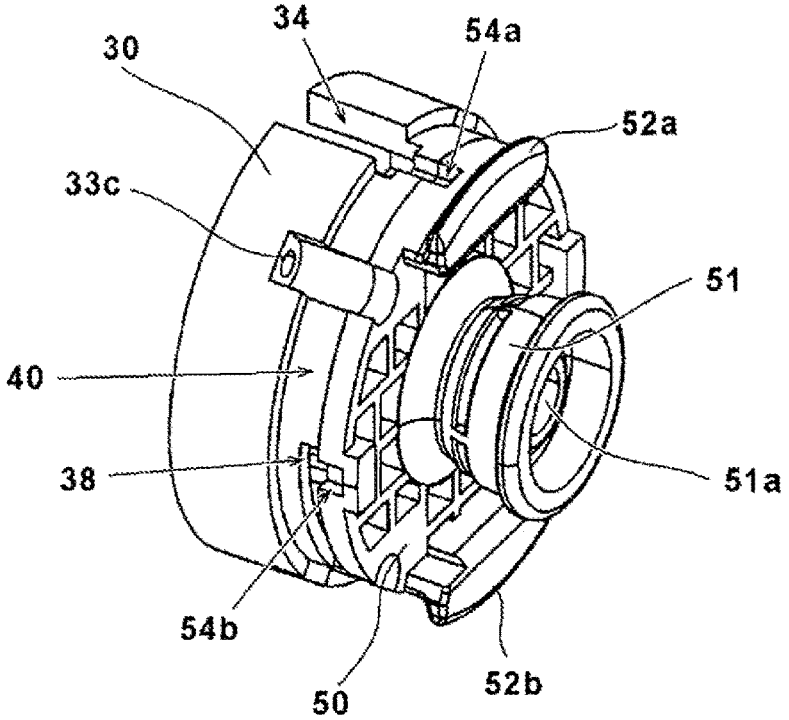
FIG. 7 is a perspective view showing a state in which the support member 30 and the intermediate member 50 in FIG. 4 are assembled.

FIG. 7 is a perspective view showing a state in which the support member 30 and the intermediate member 50 in FIG. 4 are assembled. Here, the stopper 28 and the vibration isolation member 45 (refer to FIG. 4 for both) have not been attached yet. During producing and assembling, the rotating shaft 58 (refer to FIG. 6(2)) of the intermediate member 50 is interposed between the right side 31*a* and the left side 31*b* of the support member 30. In this state, while the right side 31*a* and the left side 31*b* of the support member 30 are not fixed, these temporary parts are fixed to the rear side opening of the handle housing 61. This fixing is performed by passing screws (not shown) through the four screw holes 33*a* to 33*d* (in FIG. 7, only the screw hole 33*c* is shown). Screwing of these temporary parts is performed after the stopper 28 and the spring 29 are set in the stopper holding groove 34. According to such screwing, the intermediate member 50 is pivotally rotatably supported on the rear side of the motor housing 3. Then, the ring-shaped vibration isolation member 45 is attached to the step parts 40*a* and 40*b* of the support member 30. Then, the holding section 51 of the intermediate member 50 is interposed between the handle housings 61 divided into the left and right parts. The right side part and the left side part of the handle housing 61 can be fixed by a plurality of screws (not shown) that extend in a direction perpendicular to the rotation axis A1. In this manner, since the handle housing 61 is rotatably supported by the support member 30 in a swinging manner and is supported by the intermediate member 50, the rotation mechanism of the handle section 60 in the disk grinder 1 can be realized.

Figure 8:
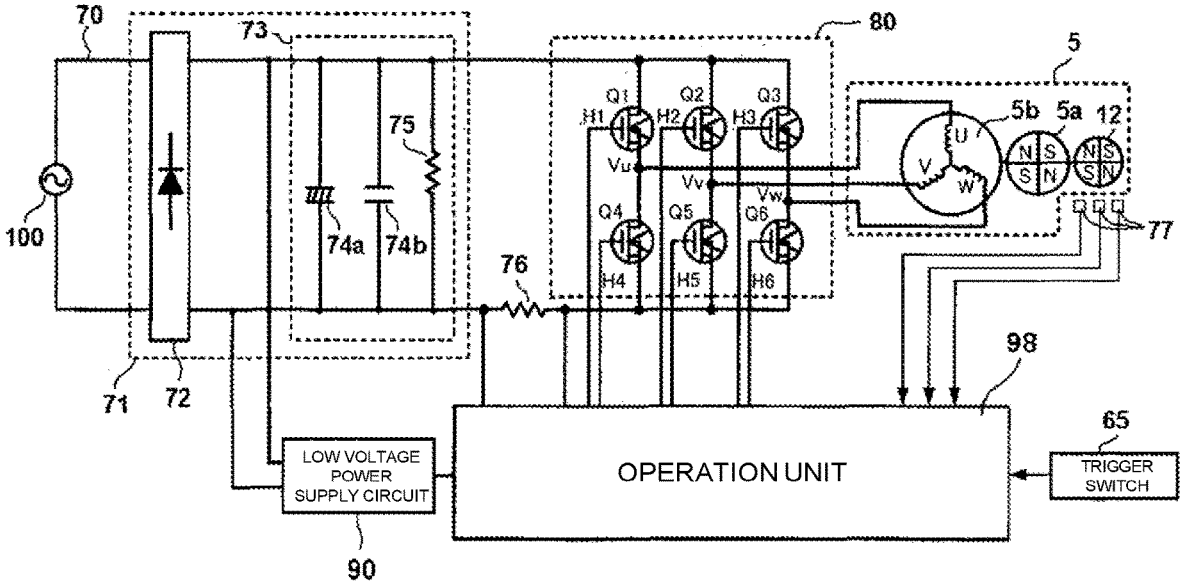
FIG. 8 is a circuit configuration diagram of a drive control system of a motor 5 in FIG. 1.

Next, a circuit configuration of a drive control system of the motor 5 will be described with reference to FIG. 8. A power supply circuit 71 includes a rectifier circuit constituted by a bridge diode 72 and the like. Between the power supply circuit 71 and an inverter circuit 80, a smoothing circuit 73 is connected to the output side of the power supply circuit 71. The inverter circuit 80 includes six switching elements Q1 to Q6, and a switching operation is controlled by gate signals H1 to H6 supplied from an operation unit 98. An output of the inverter circuit 80 is connected to U-phase, V-phase, and W-phase coils of the motor 5. A low voltage power supply circuit 90 is connected to the output side of the bridge diode 72.

The bridge diode 72 performs full-wave rectification of an alternating current input from a commercial AC power supply 100 and outputs it to the smoothing circuit 73. The smoothing circuit 73 smooths a pulsating flow included in the current rectified by the power supply circuit 71 such that it becomes close to a direct current and outputs it to the inverter circuit 80. The smoothing circuit 73 includes an electrolytic capacitor 74*a*, a film capacitor 74*b*, and a discharging resistor 75. The inverter circuit 80 includes the six switching elements Q1 to Q6 connected in the form of a 3-phase bridge. Here, insulated gate bipolar transistors (IGBTs) are used as the switching elements Q1 to Q6, but metal oxide semiconductor field effect transistors (MOSFETs) may also be used.

The rotor 5*a* having a permanent magnet rotates inside the stator 5*b* of the motor 5. The sensor magnet 12 for position detection is connected to the rotating shaft 5*c* of the rotor 5*a*. When the position of the sensor magnet 12 is detected by a rotating position detecting element 77 such as a Hall IC, the operation unit 98 detects a rotation position of the motor 5. The rotating position detecting element 77 is mounted on the sensor board 13 (refer to FIG. 1) at a position facing the sensor magnet 12.

The operation unit 98 is a control device for controlling on and off and rotation of a motor and mainly includes a microcomputer (not shown). The operation unit 98 is mounted on the control circuit board 18 and controls a current flowing time and a driving voltage for U, V, and W coils in order to rotate the motor 5 based on a start signal input according to an operation of a trigger switch 65. Although not shown here, a speed change dial for setting a rotational speed of the motor 5 is provided, and the microcomputer may adjust a speed to match a speed set by the speed change dial. The output of the operation unit 98 is connected to gates of the six switching elements Q1 to Q6 of the inverter circuit 80 and supplies drive signals H1 to H6 for turning the switching elements Q1 to Q6 on and off.

Emitters or collectors of the six switching elements Q1 to Q6 of the inverter circuit 80 are connected to star-connected U-phase, V-phase, and W-phase coils. The switching elements Q1 to Q6 perform a switching operation based on the drive signals H1 to H6 input from the operation unit 98, and supply a direct current voltage supplied from the commercial AC power supply 100 through the power supply circuit 71 and the smoothing circuit 73 as 3-phase (U-phase, V-phase, and W-phase) voltages Vu, Vv, and Vw to the motor 5. A magnitude of the current supplied to the motor 5 is detected by the operation unit 98 when a voltage value at both ends of a current detection resistor 76 connected between the smoothing circuit 73 and the inverter circuit 80 is detected.

The low voltage power supply circuit 90 is a low voltage constant power supply circuit which is directly connected to the output side of the bridge diode 72 and supplies a direct current of a stabilized reference voltage (low voltage) to the operation unit 98 constituted by a microcomputer or the like. The low voltage power supply circuit 90 is a known power supply circuit including a diode, a smoothing capacitor, an IPD circuit, a regulator, and the like. Although not shown in FIG. 1, the low voltage power supply circuit 90 is preferably mounted on the control circuit board 18 or the inverter circuit board 19, and by disposing it thereon, it is possible to reduce the number of wirings that pass between the support member 30 and the intermediate member 50.

Figure 9:
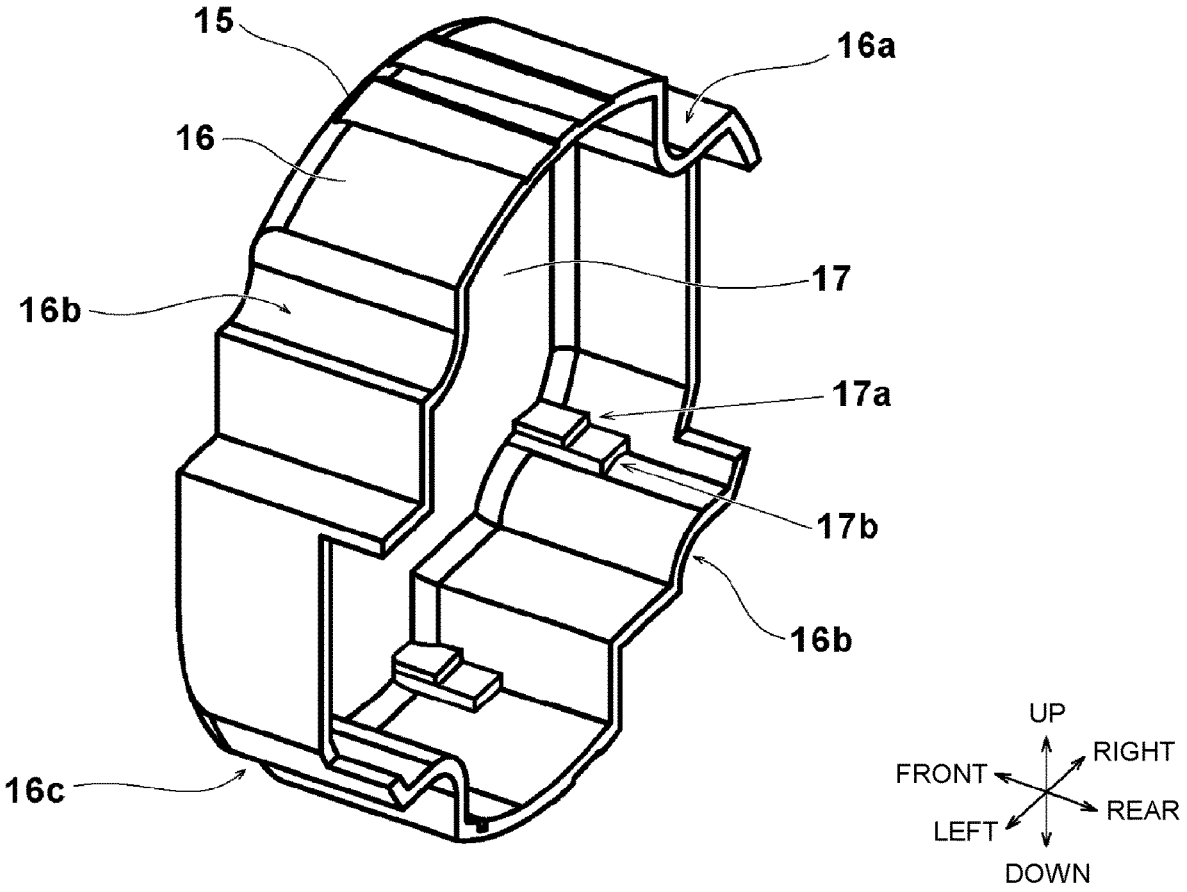
FIG. 9 is a perspective view of a cylindrical case 15 separate unit in FIG. 1.

FIG. 9 is a perspective view of the cylindrical case 15 separate unit in FIG. 1. The inverter circuit is mounted on the inverter circuit board 19 that extends in a direction substantially perpendicular to the rotating shaft 5*c* of the motor 5, and the inverter circuit board 19 is accommodated in the cylindrical case 15 having an opening. The cylindrical case 15 is produced by integral molding of a synthetic resin and an outer circumferential surface 16 is formed in a container shape from the outer edge part of a bottom surface 17. The opening of the cylindrical case 15 faces the side of the air intake hole 66 (here, the rear side). In four parts on the outer circumferential surface 16, dent parts 16*a* to 16*d* for avoiding screw bosses (formed on the inner wall surface of the motor housing 3) (not shown) for screwing are formed. The sensor board 13 and the control circuit board 18 are fixed into the cylindrical case 15 together with the inverter circuit board 19. At four corners of the bottom surface 17 of the cylindrical case 15, step parts 17*a* and 17*b* for holding the control circuit board 18 and the inverter circuit board 19 that are raised from the bottom surface 17 are formed. In addition, although not shown here, a cylindrical rib for fixing the sensor board 13 is formed at the center of the bottom surface 17. While electronic components such as the control circuit board 18 and the inverter circuit board 19 are mounted and held by the step parts 17*a* and 17*b*, a liquid resin is poured into the cylindrical case 15 and cured so that a metal terminal part such as an IGBT mounted on the inverter circuit board 19 is covered.

As above, while an example of the disk grinder having substantially a cylindrical motor housing and the handle section that extends to the rear side has been described in Example 1, the present invention is not limited to a disk grinder, and it can be similarly applied to a rotation mechanism of an arbitrary electrically powered tool including a body part including a motor and a handle section that extends from the body part to the rear side or the lateral side. In addition, in the above example, the motor housing 3, the support member 30, the intermediate member 50, and the handle section 60 are disposed in this order from the front to the rear side, but the present invention is not limited to this order. The present invention may be an electrically powered tool having a structure in which the handle section is rotatably supported by the support member 30 and is supported by the intermediate member 50 in a swinging manner. For example, positions of the support member 30 and the intermediate member 50 may be reversed. Here, while the electrically powered tool in which the rotation axis of the motor 5 and the rotation axis of the handle section 60 coincide with each other has been exemplified in the above example, an electrically powered tool in which such rotation axes do not coincide with each other may be used.

Example 2

Figure 10:
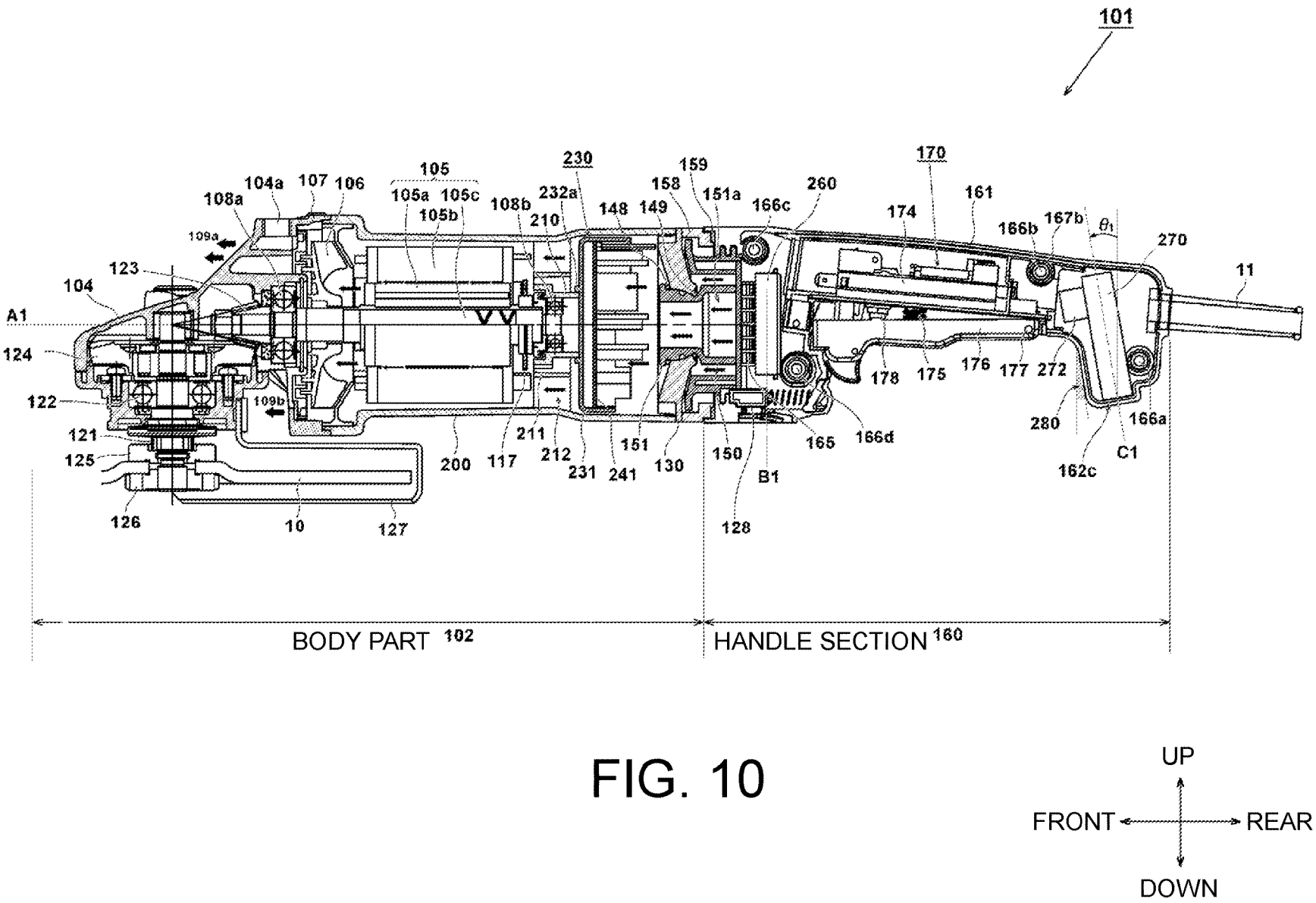
FIG. 10 is a longitudinal cross-sectional view showing an overall structure of a disk grinder 101 which is an electrically powered tool according to Example 2 of the present invention.

Next, a second example in which disposition of a circuit board in an electrically powered tool is improved will be described. FIG. 10 is a cross-sectional view showing an overall structure of a disk grinder 101 in which disposition of a circuit board is improved. A basic configuration of the disk grinder 101 is the same as that of Example 1, and a motor 105 as a driving source is accommodated inside a cylindrical motor housing 200 and drives a work device (the grinding stone 10). A handle section 160 that an operator grips is rotatably disposed on the rear side of a body part 102.

The body part 102 is constituted by a part accommodated in the cylindrical motor housing 200 and a power transmission mechanism connected to the front side thereof. The brushless type motor 105 is accommodated inside the motor housing 200. The motor 105 includes a rotor 105*a* having a permanent magnet that is disposed on the inner circumferential side and a stator 105*b* having a coil on the outer circumferential side, and is accommodated inside from the front side opening of the motor housing 200. A rotating shaft 105*c* of the motor 105 is rotatably held by a bearing 108*b* provided in the vicinity of the center part of the motor housing 200 and a front side bearing 108*a* held by a gear case 104. The power transmission mechanism has substantially the same configuration as that of the first example except for sizes and shapes, and includes the disk-shaped grinding stone 10 attached to a spindle 121 that is pivotally supported on the gear case 104 by a bearing 122 and a wheel guard 127. A pair of bevel gears 123 and 124 are disposed in the gear case 104, and change a direction of a rotational force of the rotating shaft 105*c* of the motor 105 and transmit it to the spindle 121. The grinding stone 10 is fixed to a lower end of the spindle 121 by a pressing fitting 126 via a bracket 125. A side handle mounting hole 104*a* is provided at the upper part of the gear case 104, and a same side handle mounting hole (not shown) is provided in a right side surface and a left side surface of the gear case 104.

An inverter circuit part 230 is inserted from the rear side opening of the motor housing 200, and the opening is then covered with a support member 130 and an intermediate member 150. The support member 130 combines a plurality of separate members and fixes outer circumferential parts thereof with a rubber damper 158 which is a first elastic body. When left and right divided pieces of the support member 130 are combined, a swing supporting section 151 of the intermediate member 150 is inserted into the vicinity of the center of the support member 130. In addition, a washer 159 is fitted into the rear side of the rubber damper 158. A circuit board 241 of the inverter circuit part 230 is a substantially circular multi-layer board having a slightly larger diameter than the external form of the motor 105 and its surface is disposed orthogonal to the rotation axis A1. In this manner, since the circuit board 241 is disposed orthogonal to the rotation axis A1, it is possible to shorten the entire length (size in a front-rear direction) of the electrically powered tool. Switching elements (to be described below) such as six insulated gate bipolar transistors (IGBTs) are mounted on the circuit board 241. The circuit board 241 on which switching elements are mounted that is accommodated inside a cylindrical case 231 having a container shape is disposed in the motor housing 200. Since the motor 105 used in Example 2 is larger and has a higher output than the motor 5 used in Example 1, for an inverter circuit driving it, a large semiconductor element (IGBT) that can switch a large current is used, and the size of the circuit board 241 necessary for mounting them increases. Therefore, the diameter of the motor housing 200 in a part in which the inverter circuit part 230 is accommodated is formed to be slightly thicker than a part in which the motor 105 is accommodated. A small annular sensor board 117 is mounted between the bearing 108*b* and the stator 105*b* when viewed in the direction of the rotation axis A1. The sensor board 117 has an annular board part and three rotating position detecting elements 114 (to be described below) such as a Hall IC are mounted at intervals of 60 degrees on the side facing the stator 105*b*. The rotating position detecting element 114 (to be described below) detects a magnetic field generated by the rotor 105*a* and thus detects a position of the rotor 105*a*. An attachment part (not shown) that extends outward in the radial direction from two opposing parts of a board part of the sensor board 117 is provided. The sensor board 117 is screwed to the motor housing 200 using a screw hole provided in the attachment part and a screw boss (not shown) formed in the part of a rib 211.

A cooling fan 106 is provided on the side in front of the motor 105 between it and the bearing 108*a*. The cooling fan 106 is a centrifugal fan and sucks air on the side of the motor 105 and discharges it outward in the radial direction. According to an air flow generated by the cooling fan 106, an air flow is generated in a direction indicated by a black arrow in the drawing. First, outside air is taken from a slit-shaped air intake hole 165 formed on the side of the handle section 160, and then caused to pass through a through-hole and an air flow window (to be described below in FIGS. 11 and 12; not shown in FIG. 10) formed on the intermediate member 150 and the support member 130, and flow into an internal space of the motor housing 200 from the rear side opening of the motor housing 200. The flowing air flow first cools the electronic components mounted on the inverter circuit part 230, then passes through an incision part (to be described below in FIG. 11) on the side of the inverter circuit part 230, and reaches the vicinity of a bearing holder 210 through an interval between the outer circumferential side of the cylindrical case 231 of the inverter circuit part 230 and the motor housing 200. Since a plurality of air flow windows 212 are formed on the outer circumferential side of the bearing holder 210, an air flow that has passed through the air flow window 212 reaches the side of the motor 105.

The air flow passes between the rotor 105*a* and the stator 105*b*, and between the stator 105*b* and an inner wall part of the motor housing 200, is sucked from the vicinity of the axial center of the cooling fan 106, flows outward in the radial direction of the cooling fan 106, and passes through an air hole formed on the outer circumferential side of a bearing holder 107. Some of cooling air discharged from the bearing holder 107 is discharged to the outside through an exhaust port (not shown) formed in the gear case 104 as indicated by an arrow 109*a*, and the remaining air is discharged to the outside through an exhaust port (not shown) in the vicinity of the lower side of the bearing holder 107 as indicated by an arrow 109*b*. As described above, outside air is sucked by the handle section 160 using the cooling fan 106 and the air flows from the rear side to the front side of the motor housing 200. In this case, since the inverter circuit part 230 with the largest amount of heat generated is disposed on a windward side in cooling air in which air is most likely to cool, which is a part ahead of the motor 105 (the bearing 108*b*), electronic elements mounted on the inverter circuit part 230, particularly, semiconductor switching elements can be efficiently cooled. In addition, when the cylindrical integral motor housing 200 is formed, it is possible to firmly pivotally support the motor 105 compared to supporting by a housing that can be divided, and sufficient rigidity can be secured.

The handle section 160 is a part that an operator grips during working, and a case body thereof includes a handle housing 161 of a left and right two-division type formed by molding a plastic, and is fixed by four screws 166*a* to 166*d*. The handle section 160 can be rotated 90 degrees to one side and 90 degrees to the other side about the rotation axis A1 from the state in FIG. 10, and the handle section 160 can be fixed to the motor housing 200 in a rotated state. As a result, it is possible to improve workability according to the rotation type handle section 160. In order to realize rotation about the rotation axis A1, the rotation mechanism is different from the rotation mechanism shown in Example 1. In Example 1, the intermediate member 50 fixed on the side of the handle housing 61 rotates relative to the support member 30 fixed to the motor housing 3. That is, the support member 30 and the intermediate member 50 constitute the rotation mechanism.

The support member 130 and the intermediate member 150 that are in a relatively non-rotatable state are held on the side of the motor housing 200, the handle housing 161 is relatively rotatable with respect to the intermediate member 150, and thus the rotation mechanism of the handle section 160 is realized. That is, the intermediate member 150 and the handle housing 161 constitute the rotation mechanism. In addition, the hollow and cone-shaped (bell-shaped) swing supporting section 151 is formed on the side in front of the intermediate member 150 and its bell-shaped outer circumferential surface (curved surface part) is held by the support member 130. Therefore, the support member 130 and the intermediate member 150 are disposed to realize a vibration control mechanism of the handle section 160, the intermediate member 150 is slightly swingable with respect to the support member 130, and an elastic body to be described below is disposed within the swing range. The principle of vibration control, that is, movement of the swing supporting section 151 and the intermediate member 150, is the same as movement of the holding section 51 of the mounting member 62 of Example 1 (refer to FIG. 2 and FIG. 3). A stopper mechanism 128 for preventing rotation of the handle housing 161 about the rotation axis A1 is provided at a front lower side end of the handle housing 161. The stopper mechanism 128 is movable in a direction (front-rear direction) parallel to the rotation axis A1, a stopper piece that extends rearward in the axial direction is engaged with any of dent parts 154*a* to 154*c* (to be described below in FIG. 12) formed in the intermediate member 150, and thus a position of the handle section 160 in the rotation direction is fixed. Here, in the same manner as in the first example, the handle section 160 is rotated to a position of +90 degrees and a position of −90 degrees about the rotation axis A1 from the reference position in FIG. 10 and can be fixed at any of three positions.

A control circuit part 260 is accommodated behind the intermediate member 150. The control circuit part 260 is sandwiched by the handle housing 161 such that it extends in a direction perpendicular to the rotation axis A1. In the control circuit part 260, a control circuit board 262 (to be described below) as a second circuit board is accommodated in a shallow case having a container shape. A control circuit of the motor 105 including a microcomputer is mounted on the control circuit board 262. When an inverter circuit and a control circuit are divided into separate boards (a first circuit board and a second circuit board), it is possible to minimize an increase in the size of a circuit board when all circuits are concentrated on a single board and it is possible to reduce the size of the tool. The control circuit part 260 is provided slightly rearward from a position at which the air intake hole 165 is formed when viewed in a direction of the rotation axis A1, and the air intake hole 165 as an air flow window is disposed between the circuit board 241 and the control circuit part 260. Since an amount of heat generated by an electronic component mounted on the control circuit part 260 is not so large, the priority for cooling with cooling air is lower than that for the circuit board 241 on which an inverter circuit is mounted. When the air intake hole 165 is disposed between the circuit board 241 and the control circuit part 260, cooling air flowing from the air intake hole 165 first hits the circuit board 241 and objects mounted thereon among the electronic elements and the circuit board 241 (inverter circuit) can be preferentially cooled. In this manner, as long as the circuit board 241 (board on which an inverter circuit is mounted) can be preferentially cooled, a position at which the air intake hole 165 is formed may be freely set in the handle section 160.

The power cord 11 for commercial AC power supply is connected to a rear end side of the handle section 160, and at position close to the drawn power cord 11, a filter circuit part 270 on which an electrical component for noise reduction is mounted is provided. The configuration of the filter circuit part 270 is realized in the same manner as in the configuration of the control circuit part 260 and is formed by accommodating a third circuit board on which a filter circuit such as a choke coil 272, a discharge resistor, a film capacitor, a varistor, and a pattern fuse is mounted in a rectangular parallelepiped housing case (not shown) having an opening on one side, pouring a curable resin into the housing case and performing curing. Here, some of parts such as a choke coil are exposed to the outside from the curable resin, but almost all of the other parts are covered with the curable resin.

The filter circuit part 270 is bent forward and then disposed so that a center surface C1 parallel to the third circuit board has an angle $\theta_1$ with respect to the vertical surface. The opening of the housing case in this case is on the front side and the choke coil 272 protrudes from a part of the opening to the front side. That is, the third circuit board of the filter circuit part 270 is inclined with respect to the rotation axis A1 and accommodated so that a protrusion direction of the choke coil 272 as a filter element and an extension direction of the grip section cross each other. The reason why the filter circuit part 270 that is inclined to the front side is disposed in this manner is that, when the center surface C1 is made to be oblique, the shape on the rear side relative to a grip part (grip section) of the handle section 160 has a shape that extends obliquely downward. When a grip section 162*b* is formed to have a small diameter in order to secure operability, an internal space is easily restricted due to formation of screw bosses. However, when the third circuit board is obliquely accommodated and a protrusion direction of the filter element is adjusted, it is easy to accommodate the third circuit board in a rim part adjacent to the grip section. In addition, according to this structure, in the shape, an oblique line 280 shape is secured, and when an operator grips the grip section, a rim part (protrusion part) 162*c* for accommodating the filter circuit part 270 is unlikely to hit a finger, and the operator can smoothly grip it. In addition, when the filter circuit part 270 is tilted to the front side, it is possible to prevent the choke coil 272 from interfering with a screw boss 167*b* for a screw 166*b*. In addition, since a space for leading the power cord 11 can be secured on the rear side of the filter circuit part 270, this is advantageous in terms of routing of the power cord 11.

A switch unit 170 for controlling turning the motor 105 on and off is disposed at the center part of the handle housing 161. The switch unit 170 includes a trigger switch 174 and a swing type trigger lever 176 disposed therebelow. The trigger lever 176 is an operation body for moving a plunger 178 of the trigger switch 174 and has one side that is pivotally supported by a rear swing shaft 177. A spring 175 that biases the trigger lever 176 in a predetermined direction is provided between the trigger switch 174 and the trigger lever 176. The operator can operate the trigger switch 174 by gripping the handle section 160. The trigger switch 174 can turn a plurality of (for example, two) power lines for commercial power supply on or off at the same time, and a power line (not shown) on the output side is transmitted to the inverter circuit part 230 through a through-hole (to be described below) of the center part of the intermediate member 150 and the support member 130. In addition, six signal lines (not shown) for transmitting a gate signal from the control circuit part 260 to a semiconductor switching element (to be described below) and other signal lines (not shown) pass through the through-hole (to be described below) of the center part of the intermediate member 150 and the support member 130.

As described above, in Example 2, from the rear side in a direction of the rotating shaft 105*c*, the power cord 11, a third circuit board 271, the switch unit 170, the second circuit board (the control circuit board 262), the first circuit board (the circuit board 241), and the motor 105 are accommodated in this order, and also electrically connected in this order. Therefore, since electrical elements can be disposed in the order of circuit configurations, the wiring can be shortened and simplified, costs can be reduced, and an increase in the size of the tool due to unnecessary wiring can be minimized.

Next, internal structures of the motor housing 200 and the inverter circuit part 230 accommodated on the rear side thereof will be described with reference to the exploded view in FIG. 11. The motor housing 200 is produced by integral molding of a synthetic resin, and a fan housing section 201 having a larger outer diameter is formed on the side in front of a motor housing section 202 in which the motor 105 is accommodated. The inside of the fan housing section 201 is formed to have a large outer diameter in order to accommodate the cooling fan 106 (refer to FIG. 10) and screw boss sections 205*a* to 205*d* (here, in the drawing, 205*b* is not shown) for fixing the gear case 104 (refer to FIG. 10) by screws are formed at four parts on the outer circumference. In the vicinity of the rear side opening of the motor housing 200, a circuit board housing section 204 having a large diameter for accommodating the inverter circuit part 230 is formed. Here, the diameter of the circuit board housing section 204 is formed to be larger than the diameter of the motor housing section 202. Therefore, a connecting part from the motor housing section 202 to the circuit board housing section 204 is a tapered section 203 that extends in a tapered shape. In the inner part of the tapered section 203, the bearing holder 210 for holding the bearing 108*b* and the air flow window 212 (refer to FIG. 10 for both) are formed.

The inverter circuit part 230 is formed by an IGBT circuit element group 240 in which electronic components are mounted on the circuit board 241 and the cylindrical case 231 a container shape for accommodating them. The cylindrical case 231 blocks one side (front side) of a substantially cylindrical outer circumferential surface 233 with a bottom surface 232 and the IGBT circuit element group 240 is accommodated in its internal space. By disposing a switching element for driving a motor in the cylindrical case 231, it can be disposed on the side of the motor 105 relative to the control circuit board 262. Therefore, the wiring from the circuit board 241 to the motor 105 can be shortened, assembling becomes easier, a space for unnecessary wiring installed is accordingly reduced, and thus an increase in the size of the electrically powered tool can be minimized. The cylindrical case 231 is disposed such that the opening side is the side of the handle section 160 (rearward), that is, an air intake side, and the bottom surface 232 as a closed surface is disposed to face the side of the motor 105 (forward). When the inverter circuit part 230 is accommodated inside the circuit board housing section 204 on the rear side of the motor housing 200, the support member 130 is installed from the rear side thereof. The support member 130 supports the intermediate member 150 (refer to FIG. 10) and thus allows the intermediate member 150 to slide slightly with respect to the support member 130. In the vicinity of the central axis of the support member 130, through-holes 132 (132*a* and 132*b*) for inserting the swing supporting section 151 (refer to FIG. 11) whose diameter increases in a cone shape of the intermediate member 150 are formed. The inner surface shape of the through-holes 132*a* and 132*b* is formed to have a bell-shaped outer circumferential surface that is curved radially toward the front side from the rear surface of the intermediate member 150. Since the swing supporting section 151 can be inserted, the support member 130 is formed such that it can be divided into two parts in the left-right direction by a molded article of a synthetic resin. A right side 131*a* and a left side 131*b* of the support member 130 are formed in a plane-symmetrical shape with respect to a division surface. While the right side 131*a* and the left side 131*b* are combined to clamp the swing supporting section 151 of the intermediate member 150, the support member 130 is fixed to the rear side opening of the motor housing 200 using four screw holes 134*a* to 134*d* (in FIG. 11, the screw holes 134*a* and 134*d* are not shown) by screws (not shown).

On the rear side opening of the motor housing 200, screw bosses 206*a* to 206*d* in which a hole through which a screw passes is formed are formed. Semi-cylindrical pressing members 133*a* to 133*d* that extend to the front side are formed in a screw passing area of the support member 130. The pressing members 133*a* to 133*d* press a part of the rear side opening edge of the cylindrical case 231 at a position at which it abuts the cylindrical outer circumferential surface of the screw bosses 206*a* to 206*d* on the side of the motor housing 200, and thus the cylindrical case 231 is stably fixed to the inside of the motor housing 200. On outer side in the radial direction from the through-holes 132*a* and 132*b*, according to a network form of a plurality of ribs 136*a* and 136*b*, a plurality of air flow windows 137*a* and 137*b* for allowing air to flow in the axial direction are formed. In addition, a plurality of cylindrical ribs 135*a* to 135*f* which form a cylindrical outer circumferential surface from the vicinity of the outer edge of the right side 131*a* and the left side 131*b* to the rear side are formed. The cylindrical ribs 135*a* to 135*f* serve as holding sections for fitting the rubber damper 158 (to be described below in FIG. 12) for fixing so that the right side 131*a* and the left side 131*b* of the support member 130 do not come off in the left-right direction.

In the outer circumferential shape of the cylindrical case 231, dents, rail parts or the like that are continuous in the axial direction are formed along the inner shape of the circuit board housing section 204 of the motor housing 200. First, rotation preventing holding sections 234*a* to 234*d* recessed to avoid the cylindrical screw bosses 206*a* to 206*d* of the motor housing 200 are formed. In addition, rail parts 237*a* and 237*b* that extend in a direction of the rotation axis A1 are formed to be fitted to grooves 207*a* and 207*b* formed in the inner wall part of the motor housing 200. In both left and right side parts of the cylindrical case 231, incision parts 236*a* and 236*b* for securing an air passage through which cooling air that flows from the rear side of the support member 130 in the axial direction hits the vicinity of the IGBT and flows toward the motor 105 are formed.

Figure 11:
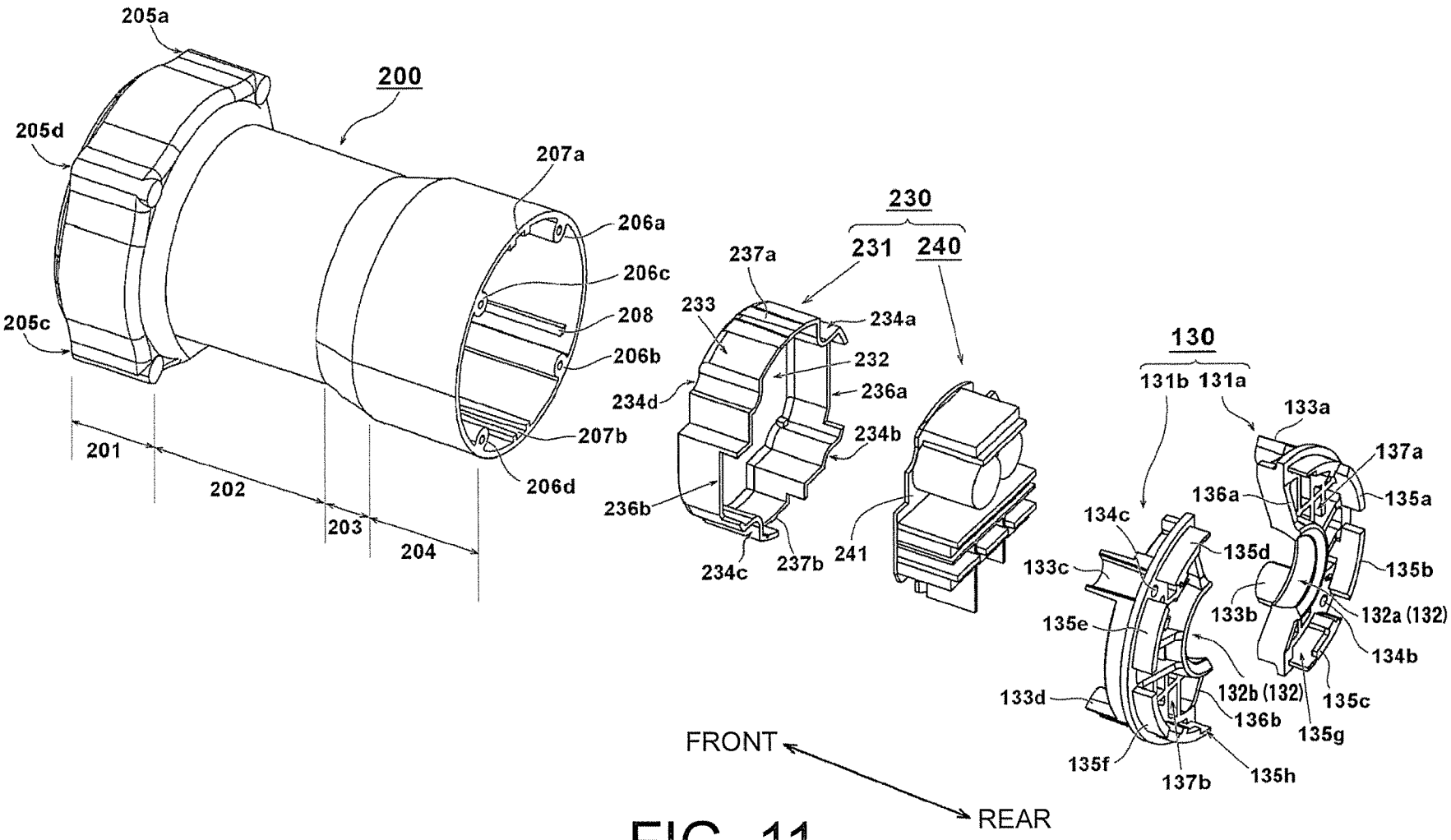
FIG. 11 is an exploded perspective view showing a configuration of a motor housing 200 and an inverter circuit part 230 in FIG. 10.
Figure 12:
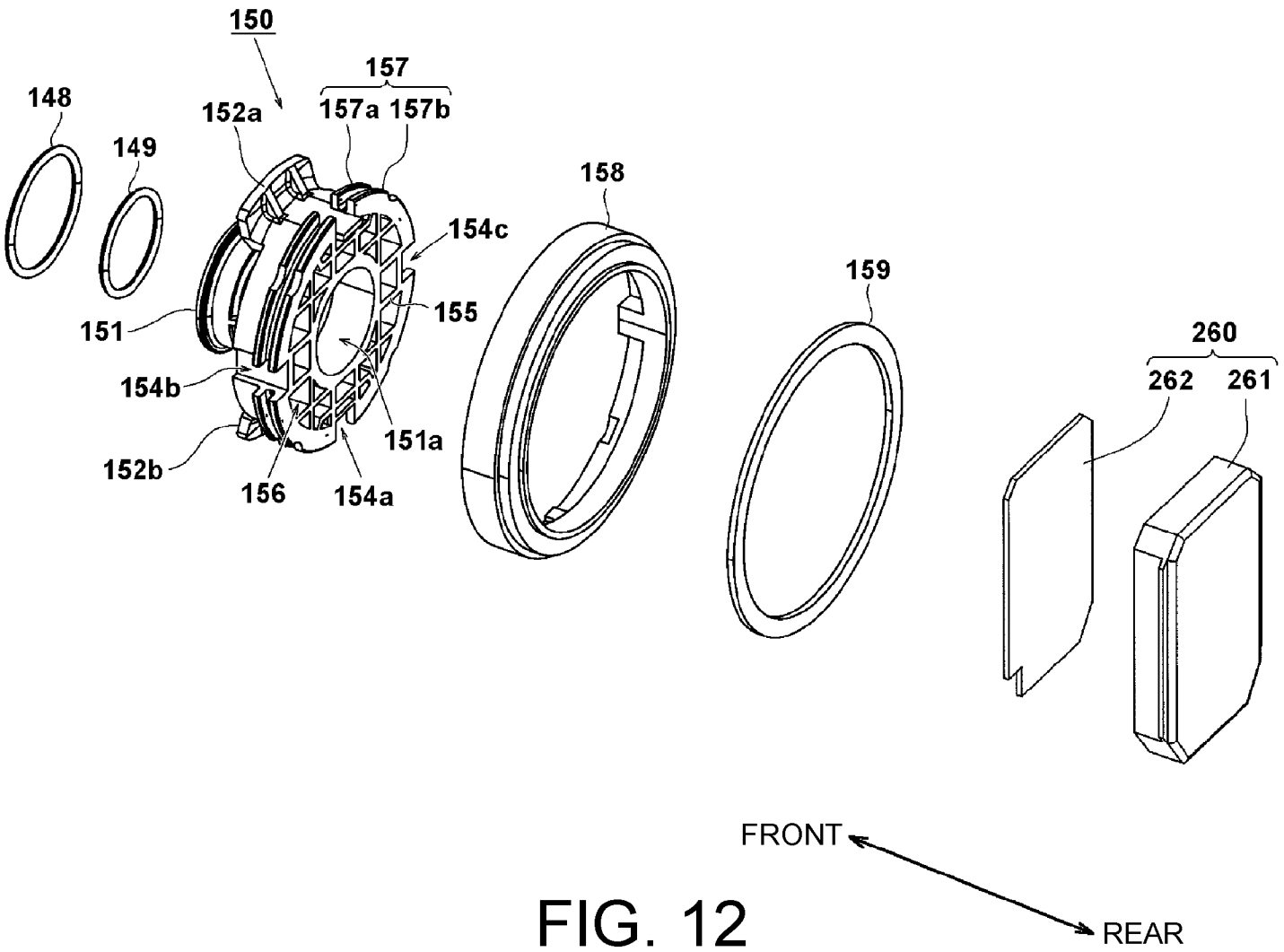
FIG. 12 is an exploded perspective view showing a configuration in the vicinity of a rotation mechanism in FIG. 10.

FIG. 12 is an exploded view of a part on the rear side relative to FIG. 11. The intermediate member 150 is provided in order to obtain a vibration control effect according to an elastic body by making the handle housing 161 slightly swingable with respect to the motor housing 200 and as a rotating shaft for performing holding for allowing rotation about the rotation axis A1 in the left-right direction. The cone-shaped wing supporting section 151 is formed on the side in front of the intermediate member 150 and elastic members 148 and 149 such as an O-ring are provided on the bell-shaped outer circumferential surface (curved surface part). The swing supporting section 151 enables the intermediate member 150 to slide with respect to the support member 130 and allows the second vibration isolation member (the elastic members 148 and 149) for preventing the sliding to be installed, and the principle of operation thereof is the same as that of the operation of the elastic members 68 and 69 (refer to FIG. 2) described in Example 1. A part (the swing supporting section 151) that supports the handle housing 161 of the intermediate member 150 in a swinging manner is applied with a load that supports the handle housing 161 and is formed in a small diameter and a small size for a double-vibration isolation structure, and thus it is necessary to secure durability thereof. However, when the intermediate member 150 is integrally formed to secure rigidity and the support member 130 in a divided form is provided, it is possible to obtain a double-vibration isolation structure in which the rigidity of the intermediate member 150 is secured.

A through-hole 151*a* is formed at the center of the intermediate member 150, and a size of the through-hole 151*a* is set to be sufficiently large to allow two power lines (not shown) and a signal line from a microcomputer to the inverter circuit part 230 to pass therethrough. In addition, a part of the through-hole 151*a* is also used for allowing cooling air to pass therethrough. A mesh shape is formed on the outer circumferential side of the through-hole 151*a* so that air can pass through in the axial direction, and a plurality of ribs 155 are formed in a network shape, and thus a plurality of air flow windows 156 are formed. These air flow windows 156 are formed at positions corresponding to the air flow windows 137*a* and 137*b* formed in the support member 130 and thus cooling air easily flows from the rear side of the intermediate member 150 toward the front side of the support member 130 through the air flow window 156 and the air flow windows 137*a* and 137*b* (refer to FIG. 12). In the vicinity of the rear side outer peripheral edge of the intermediate member 150, a rotating rail 157 (157*a*, 157*b*) formed in a rib-shape is formed. When rotating grooves 163*a* and 163*b* (refer to FIG. 13 to be described below) formed in the handle housing 161 are fitted to the rotating rails 157*a* and 157*b*, the handle housing 161 slides with respect to the intermediate member 150 in the circumferential direction about the rotation axis A1 and is relatively rotatable.

The rubber damper 158 is a first elastic body fitted to the outer circumferential side of the cylindrical ribs 135*a* to 135*f* of the support member 130, and holds the right side 131*a* and the left side 131*b* on the support member 130. The rubber damper 158 is compressed when the handle housing 161 swings in a direction (in the case of polishing, the downward direction, and in the case of cutting, the left-right direction) in which the operation of the handle housing progresses, and when movement of the handle housing 161 with respect to the motor housing 200 in the axial vibration direction is restricted, vibration transmitted from the side of the body part 102 to the handle section 160 during working can be effectively offset. Here, the rubber damper 158 is not limited to a damper made of rubber, and can be realized by a member or a mechanism that can obtain a vibration control effect with an elastic body made of a silicone elastic resin or other materials. Although the rubber damper 158 is shown on the rear side of the intermediate member 150 in FIG. 12, it is disposed at the same position when viewed in the axial direction as the intermediate member 150 as shown in FIG. 10 during installation. In the intermediate member 150, a rotation preventing part 152*a* that extends outward in the radial direction is formed, and the rotation preventing part 152*a* is disposed in the dent part inside cylindrical ribs 135*a* and 135*b* (refer to FIG. 11) of the support member 130.

Similarly, the rotation preventing part 152*b* is disposed in dent parts 135*g* and 135*h* (refer to FIG. 11) inside cylindrical ribs 135*c* and 135*f* of the support member 130. When the rotation preventing parts 152*a* and 152*b* are formed in this manner, only slight movement for obtaining a vibration control effect of the intermediate member 150 with respect to the support member 130 is allowed, and continuous relative rotation of the support member 130 and the intermediate member 150 can be prevented. At three parts on the outer circumferential part of the intermediate member 150, the dent parts 154*a* to 154*c* engaged with a stopper piece that moves in the axial direction of the stopper mechanism 128 are formed. The washer 159 as a metal annular member is interposed between the rear end part of the rubber damper 158 and the peripheral part (front outer peripheral edge) of the front side opening of the handle housing 161. When the washer 159 is inserted, it is possible to prevent wear of the rubber damper 158 when the handle housing 161 rotates.

The control circuit part 260 is accommodated in an internal space of the handle housing 161 on the rear side of the intermediate member 150. The control circuit part 260 is obtained by accommodating the control circuit board 262 on which electronic elements (not shown) such as a microcomputer and a constant voltage circuit are mounted in a container-shaped housing case 261 having a substantially rectangular parallelepiped and an opening (in the drawing, not shown) on one side. A liquid curable resin is poured into the housing case 261 and cured while the control circuit board 262 and all electronic elements mounted thereon are covered, and thus the mounted microcomputer and electronic elements are not exposed to dust or water. The housing case 261 is clamped by the handle housing 161 configured as a left and right division type and held in the handle section 160.

Figure 13:
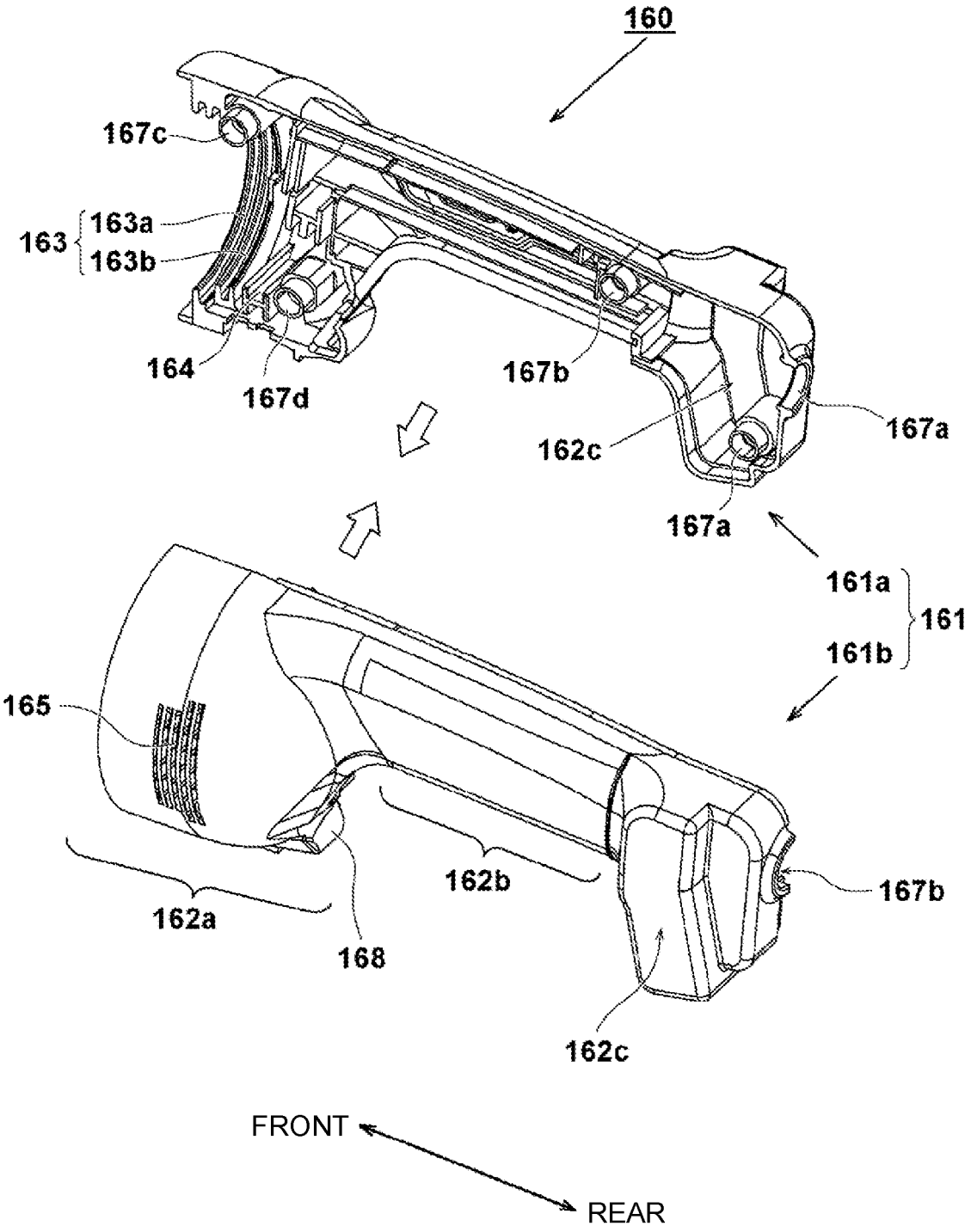
FIG. 13 is a perspective view showing the shape of a handle housing 161 in FIG. 10.

FIG. 13 is a perspective view showing the shape of the handle housing 161 in the handle section 160. The handle housing 161 can be divided into two left and right parts such as a right side 161*a* and a left side 161*b*, and is fixed in a direction of an arrow by four screws (not shown) on the screw bosses 167*a* to 167*d*. The inner shapes of the right side 161*a* and the left side 161*b* are laterally symmetrical and have substantially the same shape except for the junction part and parts of screw bosses 167*a* to 167*d*. In the shape of the handle housing 161, a grip section 162*b* that an operator grips with one hand is formed in the vicinity of the center when viewed in a direction of the rotation axis A1, and the diameter-increased section 162*a* for rotatably connecting the front side thereof to the intermediate member 150 is formed. The diameter-increased section 162*a* is a part in which the rotation mechanism is accommodated and the control circuit part 260 is accommodated. In one end part of the handle housing 161 of which a diameter needs to be increased as a connecting part of the motor housing 200, the control circuit board 262 as the second circuit board is accommodated, and thus the large size control circuit board 262 can be accommodated. On both left and right sides of the diameter-increased section 162*a*, the slit-shaped air intake hole 165 for taking cooling air into the housing is formed. Although the position and shape of the air intake hole 165 can be arbitrarily set, while securing a sufficient opening area as a whole for taking in a predetermined amount of air, the size of the opening is restricted so as to prevent entry of dust and the like. Since the air intake hole 165 is provided in the diameter-increased section 162*a* having a larger diameter than the grip section 162*b* in this manner, it is possible to prevent the operator from accidentally blocking the entire air intake hole 165 as an air flow window with a hand during working. In addition, since the air intake hole 165 is provided in the diameter-increased section 162*a* with a large surface area, it is possible to secure an amount of cooling air sucked into the motor housing 200 with a high degree of design freedom.

The diameter-increased section 162*a* has a front side on which a circular opening is formed and an inner circumferential surface in which the rotating groove 163 (163*a* and 163*b*) are formed. On the rear side of the rotating groove 163, a clamping groove 164 for clamping the housing case 261 (refer to FIG. 12) of the control circuit part 260 is formed. Since the control circuit board 262 is clamped and held by the division type handle housing 161, a part (such as a screw) for fixing the control circuit board 262 is not necessary and assembling becomes easier. On the rear side of the grip section 162*b* of the handle housing 161, the rim part 162*c* that protrudes in the downward direction and the left-right direction is formed in order to accommodate the filter circuit part 270. In the internal space of the rim part 162*c*, the housing case of the filter circuit part 270 (refer to FIG. 10) is clamped and held by the inner wall surface of the right side 161*a* and the left side 161*b*. Since the divided control circuit board 262 and a filter circuit board are vertically disposed in this manner, an increase in the size of the tool in the motor axial direction can be minimized. The diameter-increased section 162*a* and the rim part 162*c* have a shape whose diameter gradually increases away from the grip section 162*b*. When parts with a large diameter are formed in front of and behind the grip section 162*b* in this manner, it is possible to prevent the operator's hand from slipping and sliding back and forth, and since the filter circuit board as a third circuit board is accommodated in the enlarged rim part 162*c*, the large size filter circuit part 270 can be accommodated.

Figure 14:
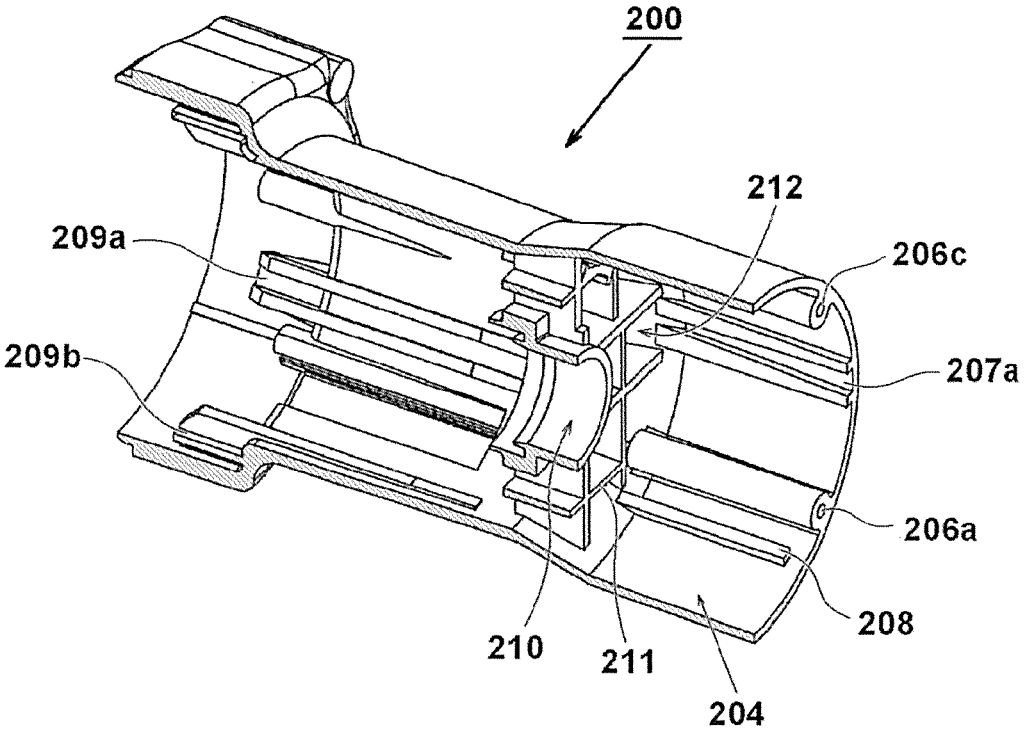
FIG. 14(1) is a cross-sectional perspective view showing an internal structure of the motor housing 200 in FIG. 11, and FIG. 14(2) is a perspective view of an inverter circuit part.
Figure 14:
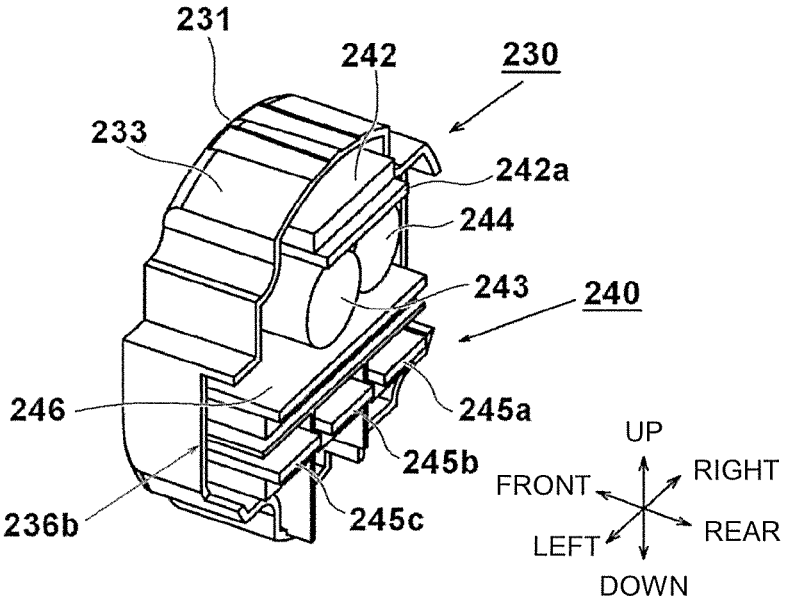

Next, the internal structure of the motor housing 200 in FIG. 11 and the shape of the inverter circuit part 230 held by the motor housing 200 will be described with reference to FIGS. 14(1) and 14(2). FIG. 14(1) is a perspective view of the upper side part when it is divided in a horizontal cross section that passes through the rotation axis A1 of the motor housing 200. Not only in Example 1 but also in Example 2, since an air flow window (intake port) and a discharge opening (exhaust port) are provided in parts other than the motor housing 200, there is no need to provide a hole for sucking or exhausting air on the side surface of the motor housing 200. In the inner part of the tapered section 203 of the motor housing 200, the cylindrical bearing holder 210 for holding the bearing 108*b* is formed. In order to support the bearing holder 210, the plurality of ribs 211 are formed in a lattice shape between the bearing holder 210 and an inner wall of the motor housing 200. The ribs 211 are support walls that are disposed parallel to the rotation axis A1, and gaps between them serve as the air flow windows 212 and cooling air can flow to the front side from the rear side in the axial direction therethrough. When the ribs 211 are formed in a lattice shape according to plate-like parts that extend in the up-down and left-right directions, compared to when cooling air can flow in the front-rear direction through ribs that extend only in one direction (for example, the up-down direction), it is possible to improve the strength of the motor housing 200.

The rear side of the rib 211 is a space for accommodating the inverter circuit part 230, and the grooves 207*a* and 207*b* and a rail part 208 are formed on the inner circumferential surface of the circuit board housing section 204. A rear end position of the cylindrical bearing holder 210 is set to be on the side to the rear of a rear end position of the rib 211, and a rear end opening surface of the bearing holder 210 is fitted to a cylindrical convex part formed in the vicinity of the center of the bottom surface 232 of the cylindrical case 231 of the inverter circuit part 230. As a result, the circuit board 241 is accommodated in the cylindrical case 231 having a container shape and thus assembling become easier, and since the opening of the cylindrical case 231 faces the side of the intake port, air from the intake port easily hits the board (air easily enters the case), and a cooling effect is improved. In addition, on the bottom surface 232 and an inlet part of the air flow window 212, a predetermined interval is provided in the axial direction. Therefore, cooling air flowing from the side upstream from the air flow window 212 can flow not only in the axial direction but also in the radial direction. The motor 105 is inserted from the front side opening of the motor housing 200 and grooves 209*a* and 209*b* for holding the stator 105*b* of the motor 105 are formed. Rail parts formed on the outer surface part of the stator 105*b* of the motor 105 are engaged with groove parts of the grooves 209*a* and 209*b* and thus the motor 105 is held.

FIG. 14(2) is a perspective view of the inverter circuit part 230. In the inverter circuit part 230, in the internal space of the cup-shaped cylindrical case 231 shown in FIG. 11, the IGBT circuit element group 240 in which the switching elements Q1 to Q6, a bridge diode 242, and capacitors 243 and 244 are mounted is accommodated. Heat dissipation plates 245*a* to 245*d* are attached to the switching elements. In addition, a heat dissipation plate 242*a* is attached to a rear surface of the bridge diode 242, and these heat dissipation plates are disposed to protrude to the rear side of the opening edge of the cylindrical case 231. Since a rectifier circuit that rectifies an alternating current and generates heat is mounted on the circuit board 241 in this manner, it is possible to cool air preferentially in the same manner as in the switching elements Q1 to Q6. In addition, the bridge diode 242 is electrically disposed between the switch unit 170 and the switching elements Q1 to Q6. Therefore, compared to when the bridge diode 242 is disposed behind the switch unit 170, the wiring from the bridge diode 242 to the switching elements Q1 to Q6 can be shortened, costs can be reduced, and assembling performance can be improved. Although not shown in the drawing, while a bottom surface of the cylindrical case 231 is horizontal, a liquid curable resin is poured into the cylindrical case 231 and cured, and thus all of the entire circuit board 241, the bridge diode 242, the capacitors 243 and 244, and terminal parts of the switching elements Q1 to Q6 are covered with the resin. In such a configuration, since metal terminal parts except for the heat dissipation plate part are not exposed to the outside, they are not influenced by dust, water, or the like, and thus it is possible to prolong the lifespan of a product resistant to vibration. In addition, since parts exposed from the curable resin to the outside are the bridge diode 242, the capacitors 243 and 244, and some of the switching elements Q1 to Q6, and particularly, parts from which heat dissipation is necessary, there is no risk of cooling efficiency decreasing due to mounting elements being completely covered with the resin. The incision parts 236*a* and 236*b* are formed in both left and right side parts of the heat dissipation plates 245*a* to 245*d* of the cylindrical case 231. Therefore, cooling air flowing from the rear side in the axial direction hits the heat dissipation plates 245*a* to 245*d* and then flows in the horizontal direction, and is discharged to the side from the incision parts 236*a* and 236*b* on both left and right sides and flows toward the motor 105.

Figure 15:
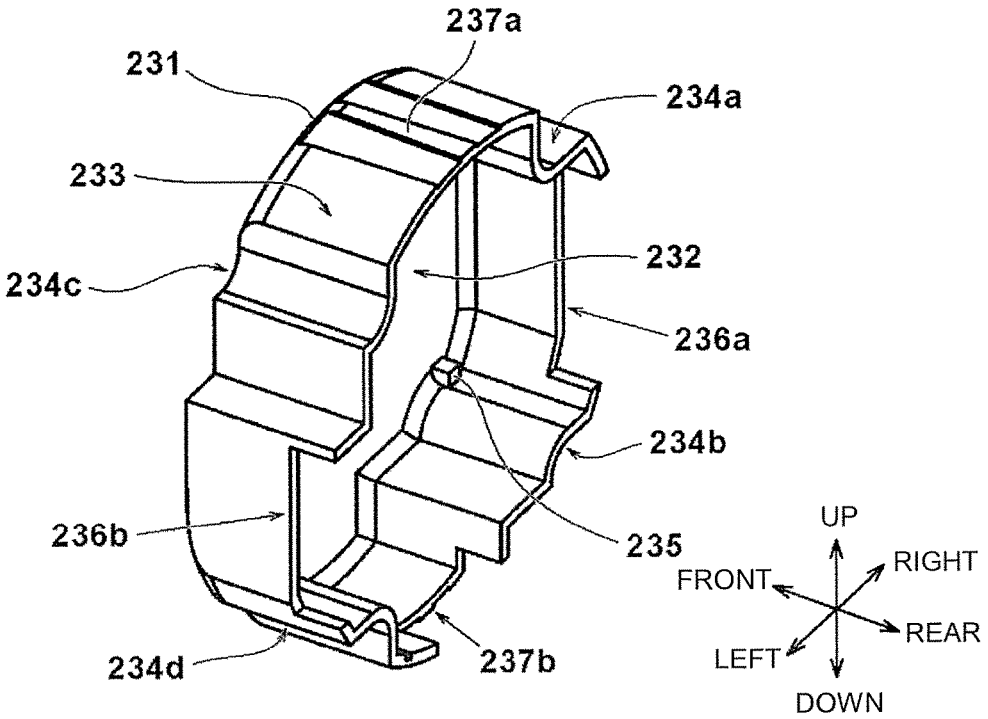
FIG. 15(1) is a perspective view showing a cylindrical case 231 in FIG. 11 and FIG. 15(2) is a rear view of an IGBT circuit element group 240.
Figure 15:
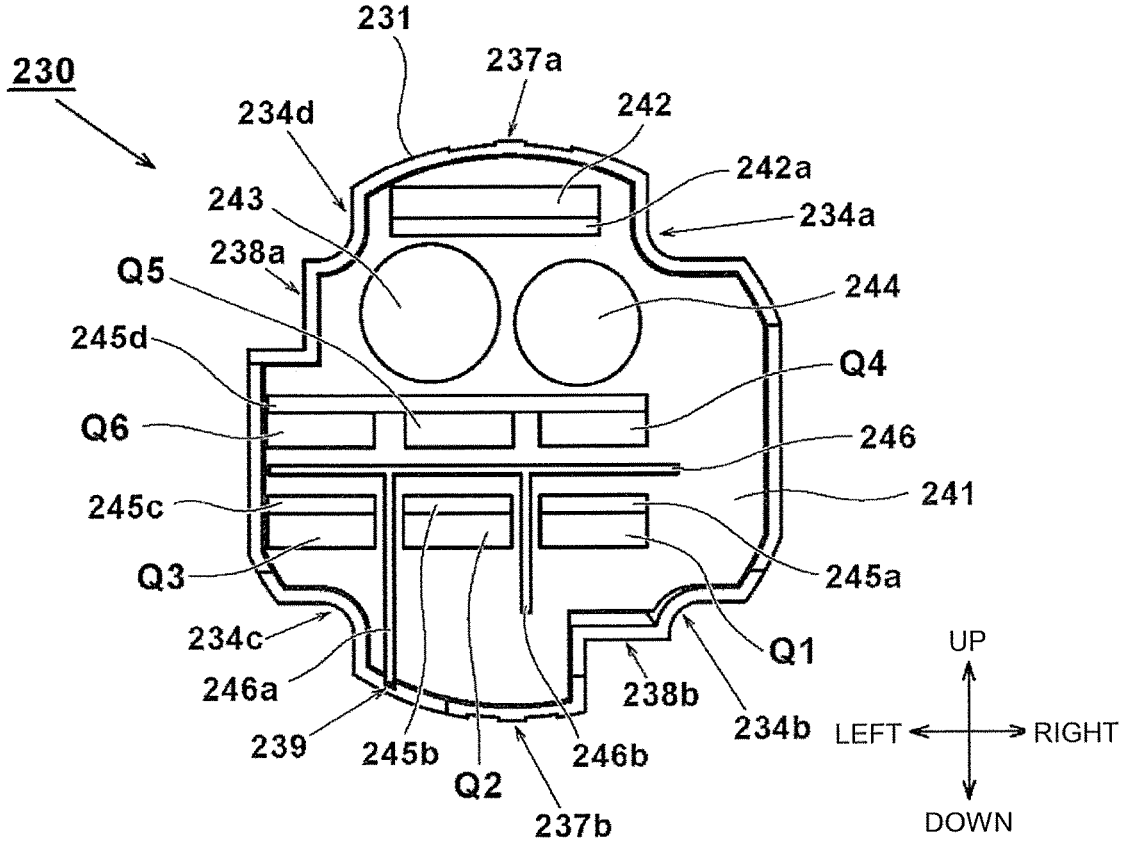

FIG. 15(1) is a perspective view showing the cylindrical case 231 in FIG. 11 and FIG. 15(2) is a rear view of the IGBT circuit element group 240. At four corners of the bottom surface 232 of the cylindrical case 231, a step part 235 for holding the circuit board 241 that is raised from the bottom surface 232 is formed. While electronic components are mounted on the circuit board 241 and held by the step part 235, a liquid resin is poured into the cylindrical case 231 to an extent that the entire circuit board 241 is filled and cured. Main electronic components mounted on the circuit board 241 are the six semiconductor switching elements Q1 to Q6. Independent metal heat dissipation plates 245*a* to 245*c* are attached to the switching elements Q1 to Q3 and are disposed such that their planar directions extend in the left-right and front-rear directions, that is, are parallel to a direction in which cooling air flows. Since heat dissipation surfaces of these switching elements Q1 to Q3 are connected to emitter terminals, the heat dissipation plates 245*a* to 245*c* are separately provided, and additionally, are blocked by a partition plate 246 as a non-conductive member. Three switching elements Q4 to Q6 are disposed above the switching elements Q1 to Q3 so that their planar directions extend in the left-right and front-rear directions. Since emitter terminals of these switching elements Q4 to Q6 are commonly grounded, as the heat dissipation plate 245*d*, a common metal heat dissipation plate 245*d* that is long in the left-right direction is provided. In the partition plate 246, when viewed in a direction in FIG. 15(2), two vertical plates 246*a* and 246*b* that extend in the downward direction from two parts of the main part that extends in the horizontal direction are formed. The lower end of the vertical plate 246*a* is fitted to a groove 239 that is formed on the inner wall of the cylindrical case 231 and extends in the axial direction and thus the partition plate 246 is provided at an appropriate position within the cylindrical case 231. The partition plate 246 is covered such that a base part comes in contact with the circuit board 241 or is brought into close contact therewith, and then about half of the partition plate 246 is filled with the resin filled into the cylindrical case 231.

The bridge diode 242 is provided in an upper part of the cylindrical case 231. The bridge diode 242 is a combination of four diodes contained in one package and the metal heat dissipation plate 242*a* is attached to a rear surface of the bridge diode 242. The bridge diode 242 is disposed such that a planar direction of the heat dissipation plate 242*a* extends in the left-right and front-rear directions, that is, parallel to a direction in which cooling air flows. The two capacitors 243 and 244 are mounted as parts below the bridge diode 242. The capacitors 243 and 244 constitute a rectifier circuit together with the bridge diode 242, and a large capacity electrolytic capacitor is used here. Although the capacitor 244 of the circuit board 241 and right side parts of the semiconductor switching elements Q1 and Q4 are not shown here, a terminal for soldering a power line connected from the trigger switch 174, a terminal for soldering a power line that transmits U-phase, V-phase, and W-phase drive power to the motor 105, and a connector terminal for connecting a wire harness for connection to the control circuit part 260 are provided. The power line connected to the motor 105 is wired through a space formed between dents 238*a* and 238*b* for leading the power line on the outer circumferential part and the inner wall surface of the motor housing 200.

Figure 16:
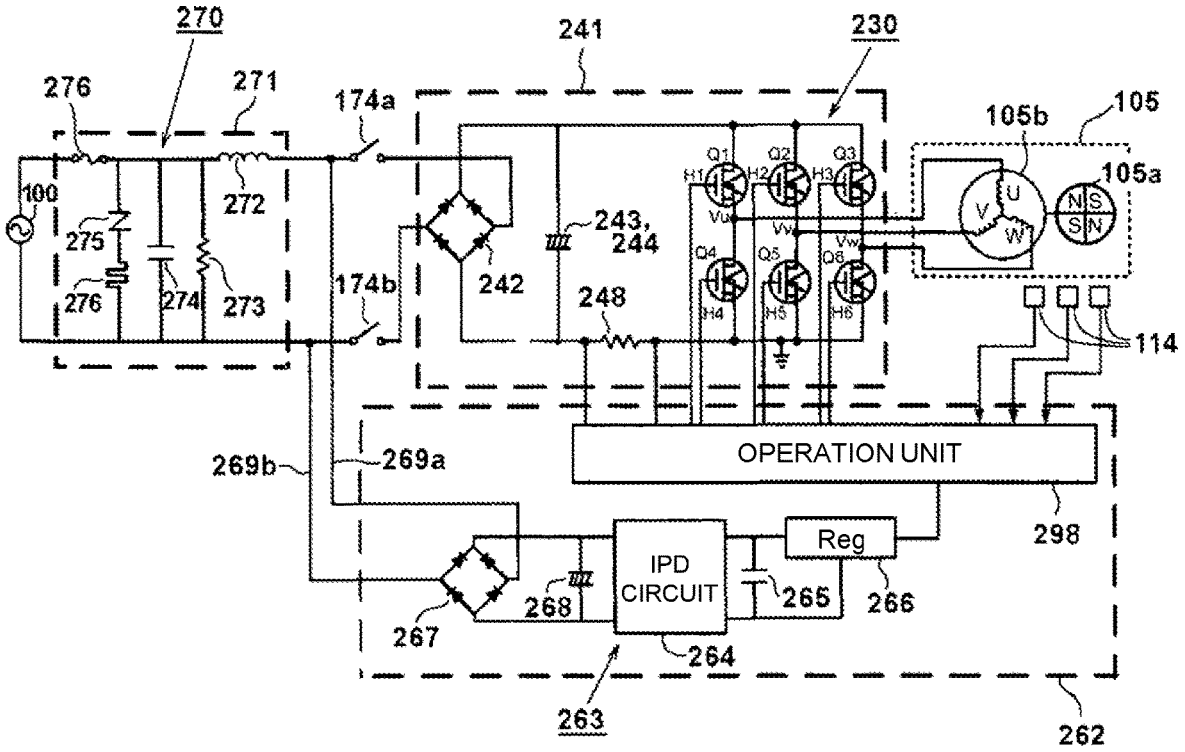
FIG. 16 is a circuit configuration diagram of a drive control system of the disk grinder 101 in FIG. 10.

FIG. 16 is a circuit configuration diagram of a drive control system of the disk grinder 101. The basic circuit configuration is the same as the circuit configuration shown in FIG. 8. Here, the trigger switch 174 (174*a* and 174*b*) in the circuit from the commercial AC power supply 100 to the bridge diode 242 and electronic elements mounted on the circuit board 271 of the filter circuit part 270, which are not shown in FIG. 8, are shown. The filter circuit part 270 mainly includes a varistor 275, a capacitor 274, and the choke coil 272 mounted on the circuit board 271. The varistor 275 is an element for protecting other electronic component from a high voltage because an electrical resistance increases when a voltage between both terminals is low and an electrical resistance rapidly decreases when a voltage becomes higher to a certain degree or more. A pattern fuse 276 is provided in series with the varistor 275 which is used for a bypass circuit that protects other elements from a sudden surge voltage. The choke coil 272 is an inductor that blocks a flow of an alternating current with a high frequency and allows only an alternating current with a low frequency to pass. In order to constitute the resonance circuit, a resistor 273 and the capacitor 274 are provided together with the choke coil 272. A fuse 277 is an electronic component for protecting a circuit from a large current that is equal to or higher than a rated value.

The trigger switch 174 is a double-pole switch that can turn the two contact points 174*a* and 174*b* on or off at the same time. In this example, the trigger switch 174 is provided on the upstream side of the bridge diode 242 and thus supply of power to the inverter circuit part 230 mounted on the circuit board 241 can be directly controlled. Branch lines 269*a* and 269*b* for supplying power to the control circuit board 262 are connected from the upstream side of the trigger switch 174, and these are connected to a low voltage power supply circuit 263. An operation unit 298 and the low voltage power supply circuit 263 for supplying a predetermined constant voltage thereto are provided on the control circuit board 262. The low voltage power supply circuit 263 includes a bridge diode 267, an electrolytic capacitor 268, an IPD circuit 264, a capacitor 265, and a three-terminal regulator(Reg) 266.

The semiconductor switching elements Q1 to Q6 including six IGBTs are mounted on the inverter circuit part 230 and constitute a drive circuit for driving a motor. The capacitors 243 and 244 are provided in parallel between the semiconductor switching elements Q1 to Q6 and the bridge diode 242. A shunt resistor 248 is mounted within the circuit to the semiconductor switching elements Q1 to Q6, and a voltage thereof is monitored by the operation unit 298. The gate signals H1 to H6 of the semiconductor switching elements Q1 to Q6 are supplied by the operation unit 298. The output of the inverter circuit part 230 is connected to U-phase, V-phase, and W-phase coils of the motor 105.

The operation unit 298 is a control device for controlling on and off and rotation of a motor and includes a microcomputer (not shown). The operation unit 298 controls a current flowing time for U, V, and W coils and a driving voltage for rotating the motor 105 based on a start signal (obtained by an electronic switch (not shown)) input according to an operation of the trigger switch 174. An output of the operation unit 298 is connected to gates of the six switching elements Q1 to Q6 of the inverter circuit part 230. Collectors or emitters of the six switching elements Q1 to Q6 of the inverter circuit part 230 are connected to star-connected U-phase, V-phase, and W-phase coils. Regarding a rotational speed of the motor 105, the rotating position detecting element 114 such as a Hall IC detects a change in the magnetic pole of the rotor 105*a* having a permanent magnet, and thus the operation unit 298 detects a rotation position of the motor 105.

As above, according to Example 2, in order to increase the cooling efficiency for the inverter circuit part 230, when the inverter circuit part 230 is disposed behind the motor 105, cooling air generated by the cooling fan 106 is efficiently applied in the structure. In addition, since an electrically powered tool with high input power needs to have a semiconductor switching element having a large size and a capacitor with a large capacity, there is a problem that it is difficult to mount them collectively on one circuit board spatially. This problem is solved by separating the circuit board 241 for an inverter circuit and the control circuit board 262 for a control circuit. In addition, the circuit board 241 for an inverter circuit is mounted inside the motor housing 200 and the control circuit board 262 is mounted inside the handle housing 161 separately, and thus an increase in the size of the electrically powered tool can be minimized. In addition, the control circuit board 262 and the circuit board 241 for an inverter circuit are connected through the through-hole 151*a* at the center of the intermediate member 150 disposed between the body part 102 and the handle section 160. However, the circuit board 241 for an inverter circuit is not directly fixed to the rear side of the stator 105*b* of the motor 105, and they are disposed in separate spaces separated to the front side and the rear side in the axial direction by the bearing holder 210 and the rib 211 within the motor housing 200. Therefore, it is possible to reduce the number of wirings necessary for connection to the motor 105 during production. In addition, in the structure of the second example, the circuit board 241 on which the semiconductor switching elements Q1 to Q6 and the like are mounted is disposed in the cylindrical case 231 and a liquid urethane is then injected and cured and thus welded parts of the semiconductor switching elements Q1 to Q6 and the circuit board 241 can be covered at once. Therefore, it is possible to improve mass productivity and perform production at low cost.

Example 3

Figure 17:
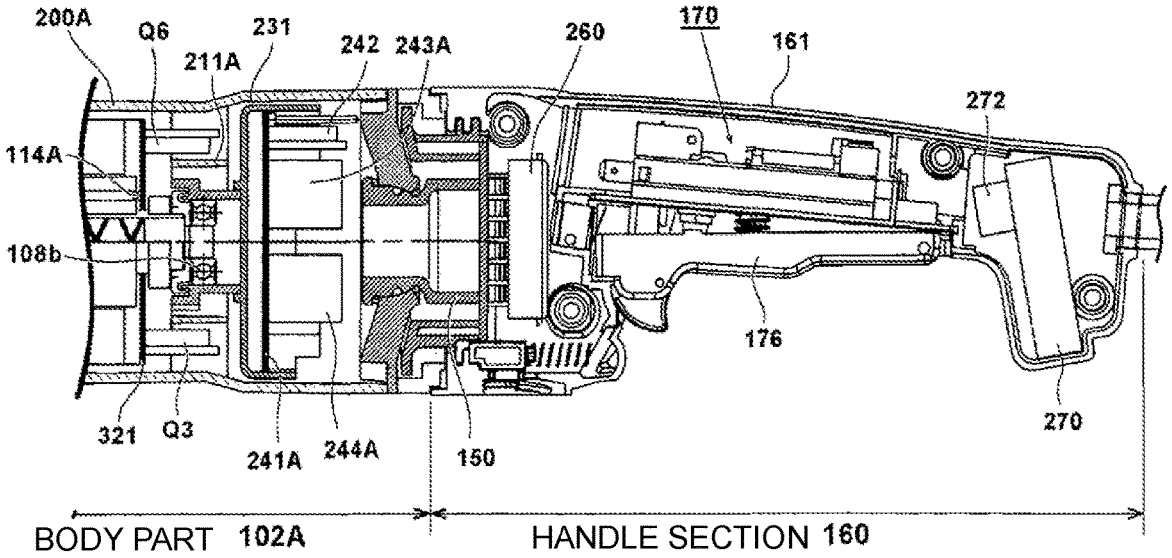
FIG. 17 is a partial cross-sectional view showing a handle section of an electrically powered tool according to Example 3 of the present invention.

FIG. 17 is a partial cross-sectional view showing a handle section 360 of an electrically powered tool according to Example 3 of the present invention. In Example 3, an annular IGBT board 321 is fixed to the rear side of the stator 105*b* of the motor 105 and the switching elements Q1 to Q6 (in the drawing, only Q3 and Q6 are shown) are mounted thereon. The structure of the handle section 160 is a structure in which the same components as in Example 2 are used and the handle housing 161 is rotatable with respect to the intermediate member 150. The structures and mounting positions, of the control circuit part 260 and the filter circuit part 270, and the configuration of the switch unit are the same as those in Example 2. The switching elements Q1 to Q6 are mounted on the IGBT board 321 at intervals of 60° in the circumferential direction about the axial center (a rotating shaft of a motor) of the motor housing 200A. In addition, the switching elements Q1 to Q6 are mounted on the IGBT board 321 such that the longitudinal direction is the front-rear direction. The shape of the motor housing 200A is the same as the shape of Example 2 except for the shape of the rib 211A. The cylindrical case 231 is the same as that in Example 2. The circuit board 241A has the same external form as that of the circuit board 241 of Example 2, but elements mounted thereon are different from those in Example 2, and no switching elements Q1 to Q6 are mounted on the circuit board 241A. In this manner, since the semiconductor switching elements Q1 to Q6 are mounted on the IGBT board 321, only the bridge diode 242, capacitors 243A and 244A, and the like may be mounted on the circuit board 241A, and a mounting area of the circuit board 241A is easily secured. Therefore, the capacitors 243A and 244A have a larger capacity than in Example 2, the number of capacitors is increased, and three or more (many) capacitors are easily mounted. In this manner, when the inverter circuit (switching element) and the rectifier circuit (such as a bridge diode) are mounted on separate boards, it is possible to secure an accommodation space in the cylindrical case 231 in contrast to Example 2.

A curable resin is poured into the circuit board 241A in the cylindrical case 231 and terminal parts of elements to be soldered are completely covered. On the other hand, for terminal parts of the semiconductor switching elements Q1 to Q6 (in the drawing, only Q3 and Q6 are shown) to be soldered to the IGBT board 321, it is not possible to apply a fixing method of pouring in a curable resin, and curing. Therefore, an assembling worker manually applies a silicon resin one by one. In the shape of the rib 211A at the positions at which the semiconductor switching elements Q1 to Q6 are mounted, a recess is formed in order to prevent the semiconductor switching elements Q1 to Q6 from being in contact therewith. On a surface (surface on the front side) opposite from the side on which the semiconductor switching elements Q1 to Q6 of the IGBT board 321 are mounted, at positions facing a rotational locus of the permanent magnet of the rotor 105*a*, the three rotating position detecting elements 114A are mounted. The switching elements Q1 to Q6 are disposed in a space (around the bearing 108*b*) used as an air passage and thus mounted on the circuit board 241A. Therefore, it is not necessary to increase the size of the motor housing 200A in order to mount switching elements on separate boards, and an increase in the size can be minimized and it is possible to secure an accommodation space for the cylindrical case 231. In addition, according to this example, since cooling air hits the bridge diode 242 earlier than the switching elements, the bridge diode 242 can be preferentially cooled. In addition, in Example 3, since circuits are divided into four circuit boards, and additionally, these are disposed in the electrically powered tool so that they extend in the up-down direction, an increase in the size of the circuit board can be minimized, and an increase in the size of the electrically powered tool in the front-rear direction can be minimized, compared to when all circuits are integrated on one circuit board.

Example 4

Figure 18:
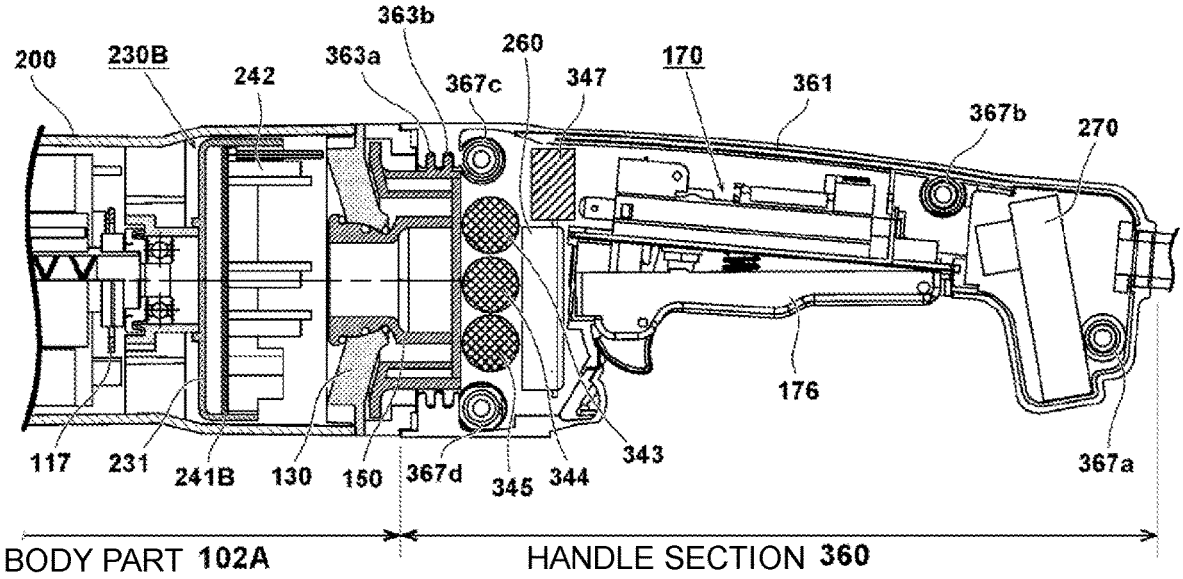
FIG. 18 is a partial cross-sectional view showing a handle section of an electrically powered tool according to Example 4 of the present invention.

FIG. 18 is a partial cross-sectional view showing the handle section 360 of an electrically powered tool according to Example 4 of the present invention. Example 4 has the same configuration as Example 2 except that only an electronic element mounted on the circuit board 241B is different from that of the configuration in the motor housing 200. Only the front part of the configuration on the side of the handle section 360 is different from that of Example 2. Capacitors 343 to 345 with a large capacity are disposed between the front side control circuit part 260 of the handle section 360 and the intermediate member 150. Here, three cylindrical shape parts of the capacitors 343 to 345 are disposed horizontally and disposed side by side in the up-down direction. In order to accommodate the capacitors 343 to 345, a position of a screw boss 367*d* of a handle housing 361 is changed. That is, a position of the screw boss 167*d* of the handle housing 161 of Example 2 is shifted like the screw boss 367*d* to approach rotating grooves 363*a* and 363*b*. Positions of the other screw bosses 367*a* to 367*c* are the same as positions of screw bosses 167*a* to 167*c* of the handle housing 161 of Example 2.

The control circuit part 260 is held at a position slightly moved rearward and downward from the disposition of Example 2, but the shape of the control circuit part 260 and the internal circuit configuration are the same as those in Example 2. A reactor 347 is disposed above the control circuit part 260. The reactor 347 is used for minimizing harmonics generated by a switching operation in the inverter circuit and is electrically connected between the capacitors 343 to 345 and a power supply input unit. While it is necessary to increase the size of the reactor 347 as a countermeasure for harmonics, since the electrically powered tool has a higher high output, the reactor 347 is disposed in a certain space between the switch unit 170 (power supply input side) and the capacitors 343 to 345, and thus the wiring from the capacitors 343 to 345 to the reactor 347 can be shortened, and a space for disposing the large size reactor 347 can be secured. The switch unit 170 accommodated inside the handle section 360 is the same as that used in Example 2 and Example 3. Here, the position of the screw boss 367*d* is shifted, and thus the stopper mechanism 128 (refer to FIG. 10) for fixing a rotation position of the handle section 360 cannot be mounted at the same position as in Example 2. Therefore, the position of the stopper mechanism 128 may be shifted to another position and disposed.

According to Example 4, since it is not necessary to mount the capacitors 343 and 344 with a large capacity on the circuit board 241B of the inverter circuit part 230B, installation of the switching elements Q1 to Q6 to be mounted on the circuit board 241B becomes easier and it is possible to further increase the size of the IGBT used as a switching element. In addition, since it is possible to prevent the capacitors 343 and 344 from being mounted in the vicinity of the switching elements Q1 to Q6 and the bridge diode 242 with a large amount of heat generated, it is possible to prolong the lifespan of the capacitors 343 and 344 and cooling air can easily hit the switching elements Q1 to Q6 and the bridge diode 242. Here, in order to improve assembling performance, the three capacitors 343 to 345 may be mounted on a newly provided circuit board.

While the present invention has been described above based on Examples 1 to 4, the present invention is not limited to the above examples, and various modifications can be made without departing from the spirit and scope of the invention. For example, while an example of a disk grinder including a substantially cylindrical motor housing and a handle section that extends to the rear side has been described in the above examples, the electrically powered tool of the present invention is not limited to a disk grinder, and it can be similarly applied to an arbitrary electrically powered tool including a body part including a motor and a handle section that extends from the body part to the rear side or the lateral side.

REFERENCE SIGNS LIST

1 Disk grinder
2 Body part
3 Motor housing
4 Gear case
4*a* Side handle mounting hole
5 Motor
5*a* Rotor
5*b* Stator
5*c* Rotating shaft
6 Cooling fan
7 Bearing holder
8*a*, 8*b* Bearing
10 Grinding stone

11 Power cord
12 Sensor magnet
13 Sensor board
15 Cylindrical case
16 Outer circumferential surface
16*a* to 16*d* Dent part
17 Bottom surface
17*a*, 17*b* Step part
18 Control circuit board
19 Inverter circuit board
20 Inverter circuit
21 Spindle (output shaft)
22 Bearing
23, 24 Bevel gear
25 Bracket
26 Pressing fitting
27 Wheel guard
28 Stopper
28*a* Stopper piece
29 Spring
30 Support member
32 Through-hole
32*a* Through-hole
33*a* to 33*d* Screw hole
34, 34*a*, 34*b* Stopper holding groove
35*a*, 35*b*, 36*a*, 36*b*, 37*a*, 37*b* Air flow window
38 Notch
39*a*, 39*b* Annular groove (rotating groove)
40, 40*a*, 40*b* Step part
45 Vibration isolation member
46*a* to 46*d* Protrusion
47*a* to 47*c* Protrusion
50 Intermediate member
50*a* Disk section
51 Holding section (swing supporting section)
51*a* Through-hole
51*b* Collar section
51*c* Sliding surface
52*a*, 52*b* Rotation preventing part
52*c* Stopper piece
53*c* Screw-passing groove
54*a* Fixing hole
55, 56*a*, 56*b*, 57 Air flow window
58 Rotating shaft (rotating groove)
59*a*, 59*b* Flange part
60 Handle section
61 Handle housing
62 Mounting member
62*b* Inner wall surface
62*c* Step part
64 Trigger lever
65 Trigger switch
66 Air intake hole (air flow window)
68, 69 Elastic member (second vibration isolation member)
71 Power supply circuit
72 Bridge diode
73 Smoothing circuit
74*a* Electrolytic capacitor
74*b* Film capacitor
75 Resistor
76 Current detection resistor
77 Rotating position detecting element
80 Inverter circuit
90 Low voltage power supply circuit
98 Operation unit
100 Commercial AC power supply
101 Disk grinder
102 Body part
104 Gear case
104*a* Side handle mounting hole
105 Motor
105*a* Rotor
105*b* Stator
105*c* Rotating shaft
106 Cooling fan
107 Bearing holder
108*a*, 108*b* Bearing
109*a*, 109*b* Exhaust direction
114, 114A Rotating position detecting element
117 Sensor board
121 Spindle
122 Bearing
123, 124 Bevel gear
125 Bracket
126 Pressing fitting
127 Wheel guard
128 Stopper mechanism
129*a* to 129*c*, 130 Support member
131*a* Right side (of support member)
131*b* Left side (of support member)
132, 132*a*, 132*b* Through-hole
133*a* to 133*d* Pressing member
134*a*, 134*c* Screw hole
135*a* to 135*f* Cylindrical rib
136*a*, 136*b* Rib
137*a*, 137*b* Air flow window
148, 149 Elastic member
150 Intermediate member
151 Swing supporting section
151*a* Through-hole
152*a*, 152*b* Rotation preventing part
154*a* to 154*c* Dent part
155 Rib
156 Air flow window
157, 157*a*, 157*b* Rotating rail
158 Rubber damper
159 Washer
160 Handle section
161 Handle housing
161*a* Right side (of handle housing)
161*b* Left side (of handle housing)
162*a* Diameter-increased section
162*b* Grip section
162*c* Rim part
163, 163*a*, 163*b* Rotating groove
164 Clamping groove
165 Air intake hole (air flow window)
166*a* to 166*d* Screw
167*a* to 167*d* Screw boss
170 Switch unit
174 Trigger switch
174*a*, 174*b* Contact point
175 Spring
176 Trigger lever
177 Swing shaft
178 Plunger
200, 200A Motor housing
201 Fan housing section
202 Motor housing section
203 Tapered section
204 Circuit board housing section
205*a* to 205*d* Screw boss section
206*a* to 206*d* Screw boss

207*a*, 207*b* Groove
208 Rail part
209*a*, 209*b* Groove
210 Bearing holder
211, 211A Rib
212 Air flow window
230, 230A, 230B Inverter circuit part
231 Cylindrical case
232 Bottom surface
233 Outer circumferential surface
234*a* to 234*d* Rotation preventing holding section
235 Step part (board holding section)
236*a*, 236*b* Incision part
237*a*, 237*b* Rail part
239 Groove
240 IGBT circuit element group
241, 241A, 241B Circuit board (first circuit board)
242 Bridge diode
242*a* Heat dissipation plate
243, 244 Capacitor
245*a* to 245*d* Heat dissipation plate
246 Partition plate
246*a*, 246*b* Vertical plate
248 Shunt resistor
260 Control circuit part
261 Housing case
262 Control circuit board (second circuit board)
263 Low voltage power supply circuit
264 IPD circuit
265 Capacitor
266 Three-terminal regulator
267 Bridge diode
268 Electrolytic capacitor
269*a* Branch line
270 Filter circuit part
271 Circuit board (third circuit board)
272 Choke coil
273 Resistor
274 Capacitor
275 Varistor
276 Pattern fuse
277 Fuse
298 Operation unit
321 IGBT board
343 to 345 Capacitor
347 Reactor
360 Handle section
361 Handle housing
363*a*, 363*b* Rotating groove
367*a* to 367*d* Screw boss
A1 Rotation axis (of motor and handle section)
Q1 to Q6 Semiconductor switching element (IGBT)

What is claimed is:

1. An electrically powered tool comprising:
a cylindrical integral motor housing that accommodates and supports a brushless motor having a rotary shaft;
a cooling fan that is rotated by the brushless motor;
a spindle that is rotated by the brushless motor;
a power transmission mechanism configured to transmit a rotational force of the brushless motor to the spindle;
a handle housing connected to one side of the cylindrical integral motor housing and having a grip section;
a gear case which is attached to an other side of the cylindrical integral motor housing in an axial direction and in which the power transmission mechanism is accommodated;
a drive circuit on which a switching element is mounted and which drives the brushless motor;
a first circuit board on which the drive circuit is mounted and which is extending in a direction substantially perpendicular to a rotation axis of the brushless motor;
a second circuit board on which an operation unit configured to control the switching element is mounted; and
a support member which is detachable from the cylindrical integral motor housing,
wherein an air flow window is provided in the handle housing, and when the cooling fan rotates, air is sucked from the air flow window into the handle housing,
wherein the handle housing is configured as a separated body from the motor housing and is divisible, and the handle housing has a diameter-increased section that has a larger diameter than the grip section and is connected to the cylindrical integral motor housing,
the diameter-increased section is positioned between the grip section and the cylindrical integral motor housing, and
the air flow window is provided in the diameter-increased section, and
the second circuit board is accommodated in the diameter-increased section of the handle housing,
the cylindrical integral motor housing comprises a bearing holder supporting an end of the rotary shaft at one side of the rotary shaft and a first circuit board supporting section disposed closer to the one side of the cylindrical integral motor housing than the bearing holder,
the first circuit board is supported by the first circuit board supporting section of the cylindrical integral motor housing and is disposed between the second circuit board supported by the diameter-increased section and the brushless motor, and
wherein the cylindrical integral motor housing is integrally formed without being divisible,
wherein the first circuit board supporting section has a protrusion extending along the axial direction and restricting a rotational movement of the first circuit board,
wherein the support member is restricting an axial movement of the first circuit board supported by the protrusion even when the handle housing is not connected to the cylindrical integral motor housing,
wherein at least a part of the air flow window is disposed between the first circuit board and the second circuit board.

2. The electrically powered tool according to claim 1,
wherein the first circuit board is accommodated in a case having an opening and the opening faces an air intake side.

3. The electrically powered tool according to claim 1,
wherein the first circuit board is accommodated in the cylindrical integral motor housing.

4. The electrically powered tool according to claim 1,
wherein the second circuit board is clamped by the handle housing.

5. The electrically powered tool according to claim 1,
wherein the first circuit board and the second circuit board are disposed to extend in a direction substantially perpendicular to a rotation axis of the brushless motor.

6. The electrically powered tool according to claim 1,
wherein the handle housing accommodates a third circuit board on which a noise filter circuit is mounted, and the second circuit board is disposed between the first circuit board and the third circuit board in a rotating shaft direction.

7. The electrically powered tool according to claim 6, wherein the handle housing has a rim part having a larger diameter than the grip section on the side of the grip section opposite to the diameter-increased section, and the third circuit board is accommodated in the rim part.

8. The electrically powered tool according to claim 7, wherein the diameter-increased section and the rim part gradually increase in diameter away from the grip section.

9. The electrically powered tool according to claim 8, wherein the third circuit board includes a filter element that protrudes from a mounting surface, and the third circuit board is inclined with respect to a rotation axis of the brushless motor and is accommodated so that a protrusion direction of the filter element and an extension direction of the grip section cross each other.

10. The electrically powered tool according to claim 9, wherein a power cord for commercial AC power supply is provided in the rim part, a switch configured to turn the brushless motor on and off by an operation thereof is provided in the grip section, and in the rotational axis direction, from the rear side, the power cord, the third circuit board, the switch, the first circuit board, and the brushless motor are accommodated in this order and electrically connected in this order.

11. The electrically powered tool according to claim 10, wherein a rectifier circuit configured to rectify power supplied from the power cord is provided, and the rectifier circuit is mounted on the first circuit board and is electrically connected between the switch and the switching element.

12. The electrically powered tool according to claim 1, wherein the first circuit board is fixed to the cylindrical integral motor housing by the support member.

13. An electrically powered tool comprising:

a cylindrical integral motor housing that accommodates and supports a brushless motor;

a cooling fan that is rotated by the brushless motor;

a spindle that is rotated by the brushless motor;

a power transmission mechanism configured to transmit a rotational force of the brushless motor to the spindle;

a handle housing which is connected to one side of the cylindrical integral motor housing and in which a grip section is formed;

a gear case which is attached to an other side of the cylindrical integral motor housing in an axial direction and in which the power transmission mechanism is accommodated;

a drive circuit on which a switching element is mounted and which drives the brushless motor;

a circuit board on which the drive circuit is mounted;

a circuit board case, which has a container shape, accommodates the circuit board, and a support member which is detachable from the cylindrical integral motor housing; and wherein the cylindrical integral motor housing is integrally formed without being divisible, wherein an air flow window is provided in the handle housing, and when the cooling fan rotates, an air is sucked from the air flow window into the handle housing, the air cools the drive circuit, and then cools the brushless motor, wherein the cylindrical integral motor housing is provided with a bearing holder for holding a bearing that supports a rotary shaft of the brushless motor, and the cylindrical integral motor housing has a circuit board housing section accommodating at least a part of the circuit board, the circuit board housing section is provided at opposite to the brushless motor with respect to the bearing holder, wherein the circuit board case is inserted from an opening at the one side of the cylindrical integral motor housing, wherein the circuit board housing section has a protrusion extending along the axial direction and restricting a rotational movement of the circuit board, wherein the support member is restricting an axial movement of the circuit board case supported by the protrusion even when the handle housing is not connected to the cylindrical integral motor housing, wherein the handle housing is divisible and has a diameter-increased section that has a larger diameter than the grip section and is connected to the cylindrical integral motor housing, the diameter-increased section is positioned between the grip section and the cylindrical integral motor housing, and the air flow window is provided in the diameter-increased section.

14. The electrically powered tool according to claim 13, wherein the protrusion contacts to the circuit board case so that the circuit board case does not rotate about the axial direction.

15. The electrically powered tool according to claim 13, wherein the circuit board is fixed to the cylindrical integral motor housing by the support member.

* * * * *